US009404297B2

(12) United States Patent
Bennett et al.

(10) Patent No.: US 9,404,297 B2
(45) Date of Patent: Aug. 2, 2016

(54) LEVER ACTUATED COMPRESSION LATCH

(71) Applicant: SOUTHCO, INC., Concordville, PA (US)

(72) Inventors: Nicholas Paul Bennett, Redditch (GB); Philip John Kempson, Frampton Cotterell (GB)

(73) Assignee: Southco, Inc., Concordville, PA (US)

( * ) Notice: Subject to any disclaimer, the term of this patent is extended or adjusted under 35 U.S.C. 154(b) by 145 days.

(21) Appl. No.: 14/232,031

(22) PCT Filed: Feb. 6, 2013

(86) PCT No.: PCT/US2013/024862

§ 371 (c)(1),
(2) Date: Jan. 10, 2014

(87) PCT Pub. No.: WO2013/119614

PCT Pub. Date: Aug. 15, 2013

(65) Prior Publication Data

US 2014/0284946 A1 Sep. 25, 2014

Related U.S. Application Data

(60) Provisional application No. 61/596,187, filed on Feb. 7, 2012, provisional application No. 61/596,571, filed on Feb. 8, 2012, provisional application No. 61/597,749, filed on Feb. 11, 2012.

(51) Int. Cl.
*E05C 3/16* (2006.01)
*E05C 3/22* (2006.01)
(Continued)

(52) U.S. Cl.
CPC ..... *E05C 3/22* (2013.01); *E05B 17/007* (2013.01); *E05B 17/0025* (2013.01); *E05C 3/08* (2013.01);
(Continued)

(58) Field of Classification Search
CPC ..... E05C 3/06; E05C 19/14; E05C 3/30; F24C 15/022; Y10S 292/31; Y10S 292/49; E05B 5/00; E05B 15/0086; Y10T 292/0851; Y10T 292/0945; Y10T 292/0949; Y10T 292/081; Y10T 292/0825
USPC ..... 292/221, 111, 113, 124, 126, 98, 100
See application file for complete search history.

(56) References Cited

U.S. PATENT DOCUMENTS 3,884,514 A * 5/1975 Praska ..... E05B 65/0811 292/11
4,858,970 A * 8/1989 Tedesco ..... E05C 19/145 292/109

(Continued)

FOREIGN PATENT DOCUMENTS

CN 1851217 A 10/2006
CN 101568695 A 10/2009

(Continued)

OTHER PUBLICATIONS

EMKA Compression Latches, Catalog supplement (21 pages).

(Continued)

*Primary Examiner* — Mark Williams
(74) *Attorney, Agent, or Firm* — RatnerPrestia

(57) ABSTRACT

A lever operated compression latch has an elongated, hook-ended pawl carrying a longitudinal slot, and is cam guided and pin rotated while translated to engage and withdraw from a keeper cup. The compound movement of the pawl includes a lateral translation towards the keeper cup while rotating there into, followed by a lateral withdrawal to exert a compression force between the latch body which is attached to a door and the keeper cup which is attached to a door frame. A series of interconnected links is operated by a lever handle to fold into one another to provide a compact envelope when the latch is closed and to expand outwardly to open the latch and disengage the pawl from the keeper when operated by the lever. Of this series of links, a pair of release links operates in contact with one another, and rotates on respective individual pivot points to extend outwardly from the latch envelope to engage a striker plate portion of the keeper cup. This striker engagement causes the release links to push the latch and the door from a sealing engagement with the keeper and door jamb for a short distance, prior to the latch and the door thereafter being fully opened. This striker engagement of the release links also causes the latch links to fold inwardly which rotates and translates the pawl into keeper engagement and compression. This operation is facilitated with a floating spring having one end operating as a pivot member. A detent engages one of the links to provide a physical indication to the handle lever between the hard closed position and the closed about to open position.

49 Claims, 32 Drawing Sheets

(51) Int. Cl.

| | |
|---|---|
| ***E05C 5/00*** | (2006.01) |
| ***E05B 17/00*** | (2006.01) |
| ***E05C 3/08*** | (2006.01) |
| *E05B 63/14* | (2006.01) |
| *E05B 63/20* | (2006.01) |
| *E05B 7/00* | (2006.01) |
| *E05B 15/00* | (2006.01) |

(52) U.S. Cl.

CPC ... *E05C 5/00* (2013.01); *E05B 7/00* (2013.01); *E05B 15/006* (2013.01); *E05B 63/143* (2013.01); *E05B 63/20* (2013.01); *Y10T 292/1053* (2015.04); *Y10T 292/1076* (2015.04)

(56) References Cited

U.S. PATENT DOCUMENTS

| | | | | |
|---|---|---|---|---|
| 5,313,738 | A | 5/1994 | Thakur et al. | |
| 5,769,468 | A | 6/1998 | Armbruster | |
| 5,961,163 | A | 10/1999 | Brackmann et al. | |
| 5,979,951 | A | 11/1999 | Shimura | |
| 5,984,382 | A * | 11/1999 | Bourne | B64D 29/06 292/113 |
| 6,053,542 | A | 4/2000 | Ostrowski et al. | |
| 6,343,815 | B1 * | 2/2002 | Poe | E05C 19/145 292/113 |
| 8,016,329 | B2 | 9/2011 | Johansson et al. | |
| 8,469,436 | B2 * | 6/2013 | Wensing | B60J 5/065 292/DIG. 30 |
| 2006/0237974 | A1 | 10/2006 | Hamm et al. | |
| 2009/0235767 | A1 | 9/2009 | Garneau et al. | |

FOREIGN PATENT DOCUMENTS

| | | | |
|---|---|---|---|
| EP | 0331832 | A1 | 9/1989 |
| EP | 0 345 681 | A2 | 12/1989 |
| EP | 2 309 190 | A2 | 4/2011 |
| JP | 3430436 | B2 | 7/1998 |
| WO | WO 2008/055246 | A2 | 5/2008 |

OTHER PUBLICATIONS

Chinese Office Action mailed Aug. 17, 2015 in Chinese Application No. 201380008525.3 (with Engilsh translation).

Extended European Search Report for Application No. EP 13 72 8920 dated Jan. 19, 2016.

Chinese Office Action for Chinese Patent Application No. 201380008525.3, mailed Mar. 10, 2016.

* cited by examiner closed position
(top housing removed)

engaged position
(top housing removed)

detent position
(top housing removed)

open position
(top housing removed)

SECTION C–C

SECTION E-E

SECTION F–F

SECTION M–M

SECTION P–P

SECTION R–R

SECTION H-H

LEVER ACTUATED COMPRESSION LATCH

PRIOR APPLICATIONS

This application claims priority to U.S. Provisional Application No. 61/596,187, filed Feb. 7, 2012, and U.S. Provisional Application No. 61/596,571, filed Feb. 8, 2012, and U.S. Provisional Application No. 61/597,749, filed Feb. 11, 2012, which are incorporated herein by reference in their entirety.

BACKGROUND OF THE INVENTION

The present invention is directed to compression latches of the type used to latch gasket-lined doors or gasket-lined door jambs. Compression latches have been designed to secure gasketed doors, trunk lids, panels, covers, and other structures. Such compression latches require a pawl and a clamp or other member to compress a generally elastomeric gasket or O-ring when securing the door, trunk lid, panel, cover or other structure.

The take-up, i.e., the compression distance moved by the pawl, clamp, or other member, to pull a door against a door jamb establishes the degree of compression of the gasket and the sealing force thereof. The linear travel of a pull member, once a door makes contact with a cabinet, establishes the sealing force of the gasket. Gasketed enclosures are often found in industry. These can include computer and communications cabinets, electrical transformer enclosures, sterilizing and autoclave enclosures, incubation and artificial environment enclosures, cooling chambers and freezers, humidity and controlled environment chambers, and various types of ovens, among others.

Compression latches are generally manually operated. As such, they can be operated by a handle or a lever. Levers are found on latches where the compression forces required against a gasket are greater, or the length of travel of the pull is longer. However, compression latches are specifically adjusted or specifically designed or selected for the particular application and the particular environment in which they are used. Such particular application and particular environment can also dictate other operating features for a latch, such as the requirements for handle and door locking and position holding, as well as the proximity distance of the lock on a door to a door jamb when the pull of the latch begins to operate.

SUMMARY OF THE INVENTION

The present invention is designed to latch the door to an oven. Such an oven may be designed for many different purposes, such as a climate chamber, a drying oven, an annealing or tempering oven, or a food processing oven, among others. Each of these ovens has a gasket or seal which is compressed when the oven door is fully closed. Thus a compression latch operation is well suited for these structures.

The compression latch of the present invention is lever operated. This enables that a first latch unit can be mounted near the top of the oven door and a second latch unit can be mounted near the bottom of the door. A bar-type handle is attached to and vertically extends between the two latch levers. The vertical bar handle operates both levers and therefore both latches in unison. The latches engage respective striker-keepers mounted on the body of the oven.

It is important that the vertical bar have a specific fully closed position, a specific fully open position, and a discernable intermediate position where a technician knows the latch is still fully closed but about to start to open. This would assist in minimizing accidental openings allowing the escape of hot air and gases towards the technician.

When closing the door it is desirable that the latch pawl comes into contact with its striker/keeper at a specific distance before the door is fully closed. In this way, the further movement of the vertical bar and thereby the further movement of the respectively connected latch levers, contributes to the compressing forces each latch exerts on the door gasket. For example, the latch pawl can engage the striker/keeper when the door is 10-20 mm from being fully seated against the gasket. This would require a linear movement of a pawl/pull member slightly more than that distance in order to compress the gasket.

It is also desirable that the latch housing size be minimized so that the latch can be used with small ovens and/or relatively thin oven doors. An envelope size for the latch housing can be in the range of 40-70 cubic centimeters. An example might be about 33 millimeters long by about 85 millimeters wide by about 20 millimeters high.

It is further desirable that the handle lever of each latch, itself, has a stable locked state when the latch is in the fully open position, and that this locked state be released only when the door is pushed to the closed position with a manual force by a technician, wherein the locked state of the latch is released for the latch to move into a closing mode to engage the keeper/striker to lock and seal the door.

These are objectives that are realized in the latch design of the present invention that provides a compression operation from a small package which promotes user friendly smooth operation. The latch housing has a snap-in feature which minimizes the tooling and components needed for installation. The operation of the latch is effected by the movement of a lever handle from left to right and vice versa with an over center position indicator providing an indication when the latch is locked. A blocking feature inhibits the latch from being locked when the door is open. The design is such that a positive movement by a technician is needed to close the latch and to open it.

The latch includes a series of links which fold into one another resulting in a very small package when the latch is closed. In a closed position the footprint of the latch is essentially rectangular except for a housing mounting leg at one side and a snap-in clamp at the other side.

When manually operated, the handle lever rotates in a semi-circle, from a closed secure position, to a closed but about to engage to an open position (at the top of the arc), to beyond the top to an operational area of the semi-circle where the latch opens.

The latch utilizes a rectangular keeper/striker cup, mounted to the door jamb, having a pull engaging lip and a striker plate. An elongate lever, operated by the vertical handle, is mounted to a first pivot point for rotation. That pivot point holds a torsion spring which biases the lever to a closed position.

The lever is pinned to an elongate first link at one end of the link. The first link has a pivot point at about its mid-length for its rotation thereon. The other end of the link is pinned to a second link and pinned to a first end of an elongate pawl The lever operated compression latch has an elongate, hook-ended pawl with a pawl body having a longitudinal slot. The pawl is cam guided, and pin rotated and translated, to engage with and withdraw from a keeper cup. A fixed position cam post rides within the pawl slot and controls the pawl lateral translation. This cam also defines a pivot point about which the pawl rotates. The compound movement of the pawl includes a lateral translation towards the keeper cup while rotating there into, followed by a lateral withdrawal to exert a compression force between the latch body which is attached to a door and the keeper cup which is attached to a door frame thereby compressing the gasket.

A series of interconnected links is operated by the lever handle to fold into one another to provide a compact envelope when the latch is closed. These links expand outwardly to open the latch and disengage the pawl from the keeper when operated by the lever movement to the open state. Of this series of links, a pair of release links operates in contact with one another, and rotates on respective individual pivot points to extend outwardly from the latch envelope to engage a striker plate portion of the keeper cup. This striker engagement causes the release links to push the latch and the door from a sealing engagement of the keeper and door jamb for a short distance, prior to the latch and the door thereafter being separated and fully opened. This short distance of movement prior to the open state is a safety measure.

The striker engagement of the release links also causes the latch links to fold inwardly, which rotates and translates the pawl into keeper engagement and compression. This operation is facilitated with a floating spring having one end operating as a pivot member. A detent engages one of the links to provide a physical indication to the handle lever between the hard closed position and the closed about to open position.

From the fully closed position, when the handle, i.e., lever rotates, the pawl becomes free to translate out of the latch towards the keeper cup and the release links push the latch away from the keeper cup. This releases the compression state. Then after a slight lag and a further rotation of the lever, the pawl rotates. The pawl rotation is about 75 degrees from the keeper engagement position to a position fully rotated from the keeper and into the latch housing. When the latch is fully open, the handle lever is positively held in the open position. When the latch is fully open, the release levers are in the fully outwardly extending position. The handle lever, itself, is only released from the fully open position when the release levers strike the striker plate of the keeper cup. This causes the first and second links to rotate which releases the handle for movement.

The first link has a finger on its handle lever engaging end which engages an indentation in the handle lever to hold it fixed in the open position. The release linkage rotation causes the first link to rotate out of the fixed holding engagement with the handle lever.

The operation of the latch pawl is such that when the pawl force is released from exerting force against a gasket, the pawl finger hook continues to overlap the pull engaging lip of the striker cup. The handle when the pawl is in this position is held in a detent movement inhibited position which must be overcome by an additional force. This additional force overcomes the detent and moves the drive links, i.e., the first and second links connected to the pawl. The further movement of these drive links rotates the pawl to clear the finger hook from the striker cup and then rotates the pawl to withdraw it into the latch body. When the pawl is in the fully retracted position the release links are in their fully extended position. With the release links in the fully extended position the drive links cannot move the pawl.

BRIEF DESCRIPTION OF THE DRAWINGS

The features, advantages and operation of the present invention will become readily apparent and further understood from a reading of the following detailed description with the accompanying drawings, in which like numerals refer to like elements, and in which.

DETAILED DESCRIPTION OF THE INVENTION

The present invention is a latch 100 mounted on a door structure 501 of an enclosure such as an oven 500, FIGS. 1-4, which latch 100 has an extreme fully closed position, a detent position indicating a closed latch about to be opened, a further detent position indicating a partially opened latch, and an extreme fully open position. The latch is operated by a lever/handle. When in the extreme open position the lever/handle is held in a fixed abutment position so that it cannot be rotated towards the closed position. A release structure frees the handle when it moves against a striker plate mounted on a door jamb structure.

FIGS. 1, 2, 3, and 4 show the latch 100 mounted on an oven door 501 and the latch and door in the closed, partially released opened, opened with two latches and opened with a single latch, respectively.

Figure 5:
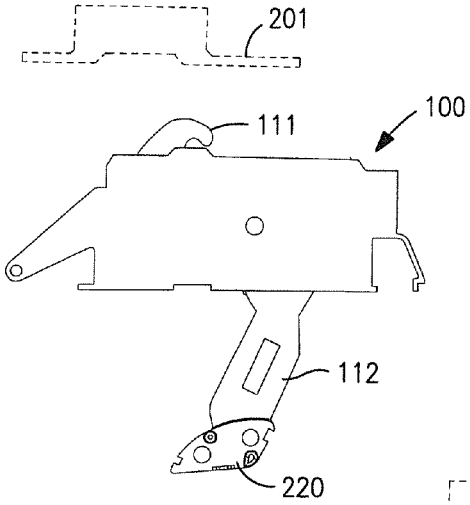
FIG. 5 is a right-hand operation latch top view with the keeper/striker in dashed lines and the latch in the fully open position.
Figure 6:
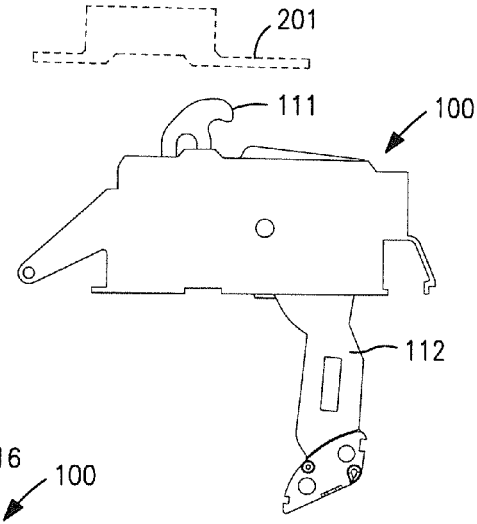
FIG. 6 is a top view of the latch of FIG. 5 in the intermediate or partial release position.
Figure 7:
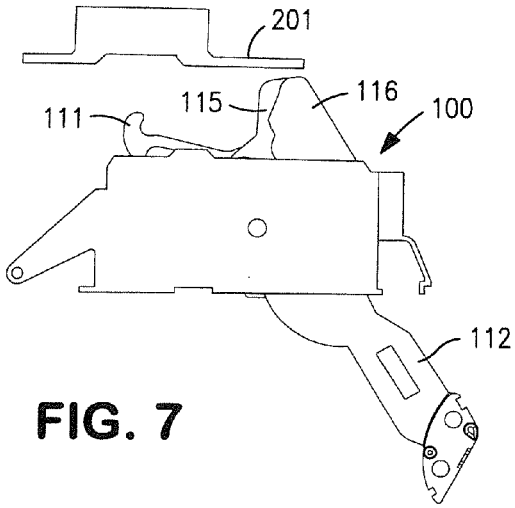
FIG. 7 is a top view of the latch of FIG. 5 in the fully open position with the release linkage extended and the hook-ended pawl rotated into the latch housing, and showing a top view of the keeper/striker.

FIGS. 5, 6 and 7 show the closed, engaged, and open positions of the latch 100, respectively. The latch 100 is designed such that the operator will not cause it to strike against the door jamb mounted keeper/striker 201 while in the closed position, FIG. 5, nor will the operator cause the latch to strike against the door jamb mounted striker 201 while in the in the engaged position, FIG. 6.

Figure 7A:
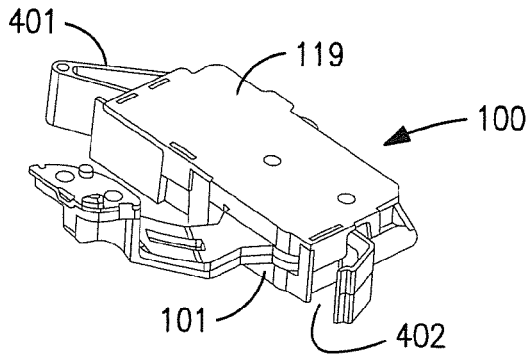
FIG. 7*a* is a perspective view of the latch.
Figure 8:
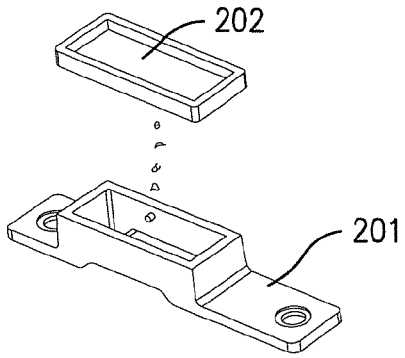
FIG. 8 is a perspective view of a keeper/striker cup used with the latch with the back of the cup exploded away.

FIG. 7*a* shows a perspective view of the latch, while FIG. 8 shows an exploded perspective view of the keeper/striker 201, 202 for the latch 100. The latch housing 101, 119 is a relatively quick installation. On one side there is an ear 401 with a vertical opening or channel 403 for a pin or screw 404. On the other side there is a spring clamp 402

Figure 1:
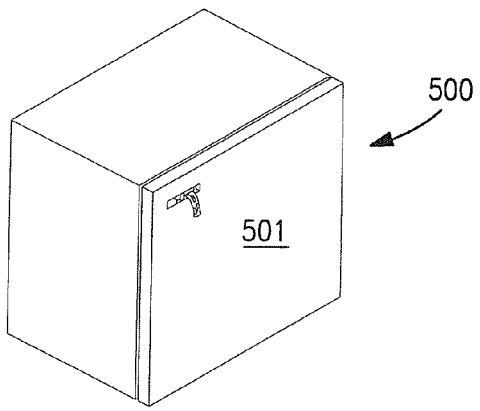
FIG. 1 is a perspective view of the latch on an oven.
Figure 2:
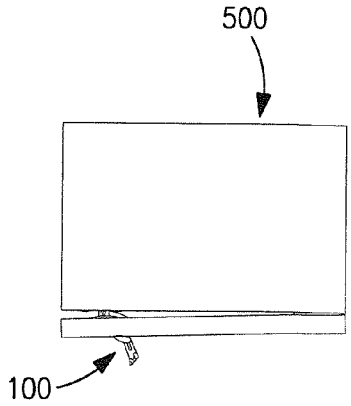
FIG. 2 is a perspective view of the door of the oven slightly open with the latch in an intermediate position.
Figure 3:
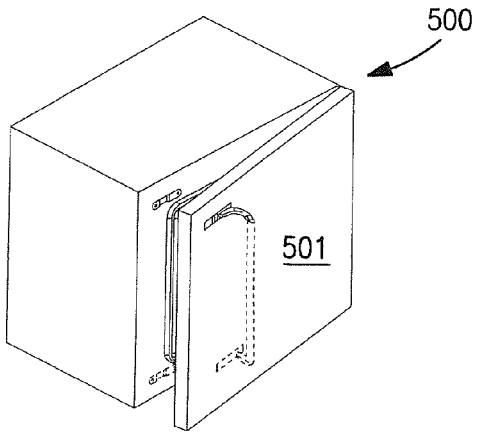
FIG. 3 is a perspective view of the oven door fully open, and there being the use of two latches, i.e., an upper and lower one, with the lower latch in dashed lines and a handle bar connecting the upper and lower latches also shown in dashed lines.
Figure 4:
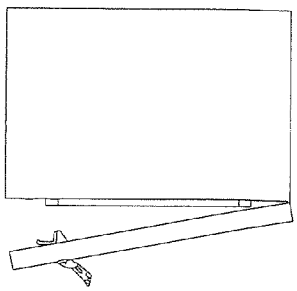
FIG. 4 is a top view of the oven of FIG. 1 with the latch fully opened and the door freely opened.
Figure 9:
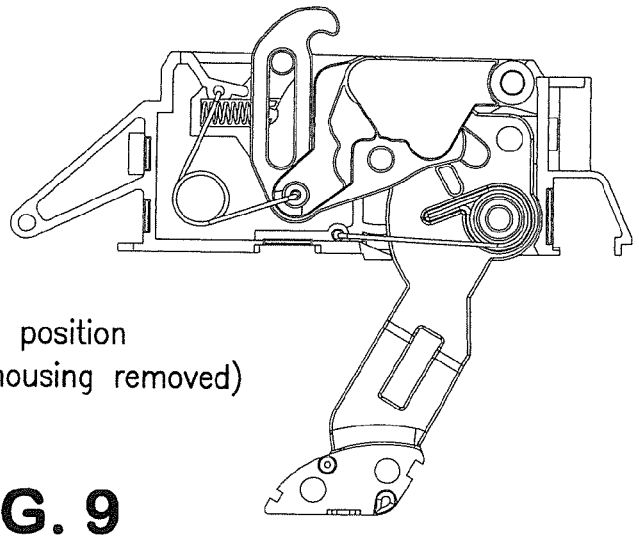
FIG. 9 is a plan/top view of the latch in the extreme closed position, the top housing member being removed.
Figure 10:
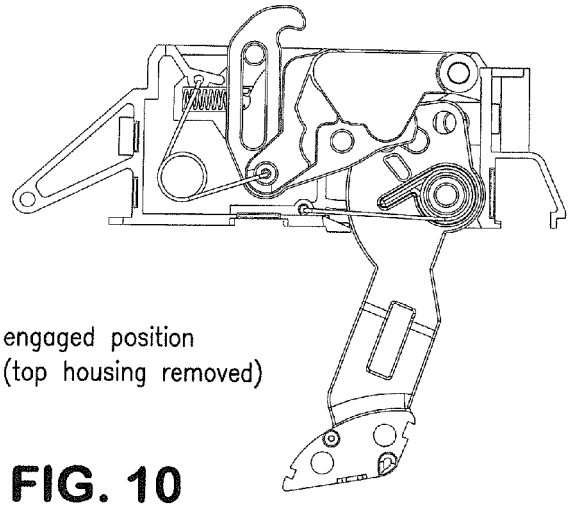
FIG. 10 is a plan/top view of the latch in the engaged position, the top housing member being removed.
Figure 11:
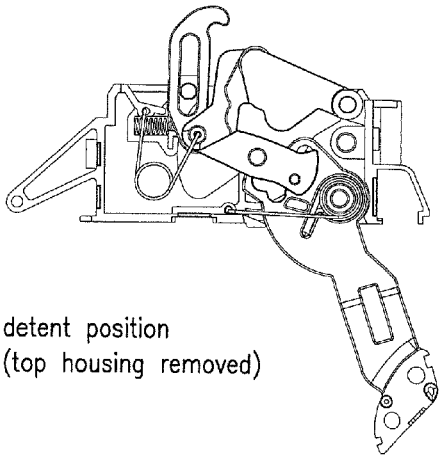
FIG. 11 is a plan/top view of the latch in the detent position, the top housing member being removed.
Figure 12:
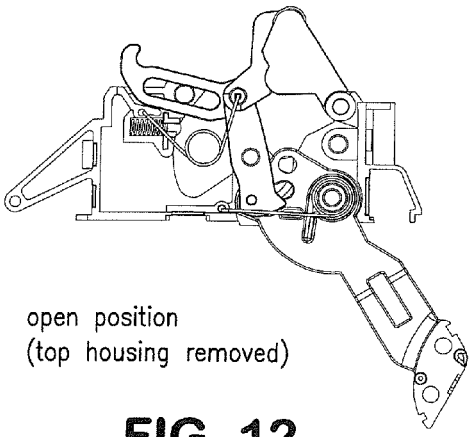
FIG. 12 is a plan/top view of the latch in the extreme open position, the top housing member 119 being removed.

With the top housing member 119 removed, the latch is shown in detail in plan top views in FIGS. 9, 10, 11, and 12. In FIG. 9, the latch 100 is in the closed position. In FIG. 10, it is in the engaged position where the pawl 111 has traveled into the keeper/striker 201 cup so that the door is somewhat opened as shown in FIG. 2, but the pawl still engages the keeper to prohibit the complete opening of the door. In FIG. 11, the latch is in the detent position where the lever/handle 112 will not move freely indicating the door should not be closed in the latch in that position. In FIG. 12 the latch is in the open position where the release links can engage the keeper striker plate 201 to close the latch.

Figure 13:
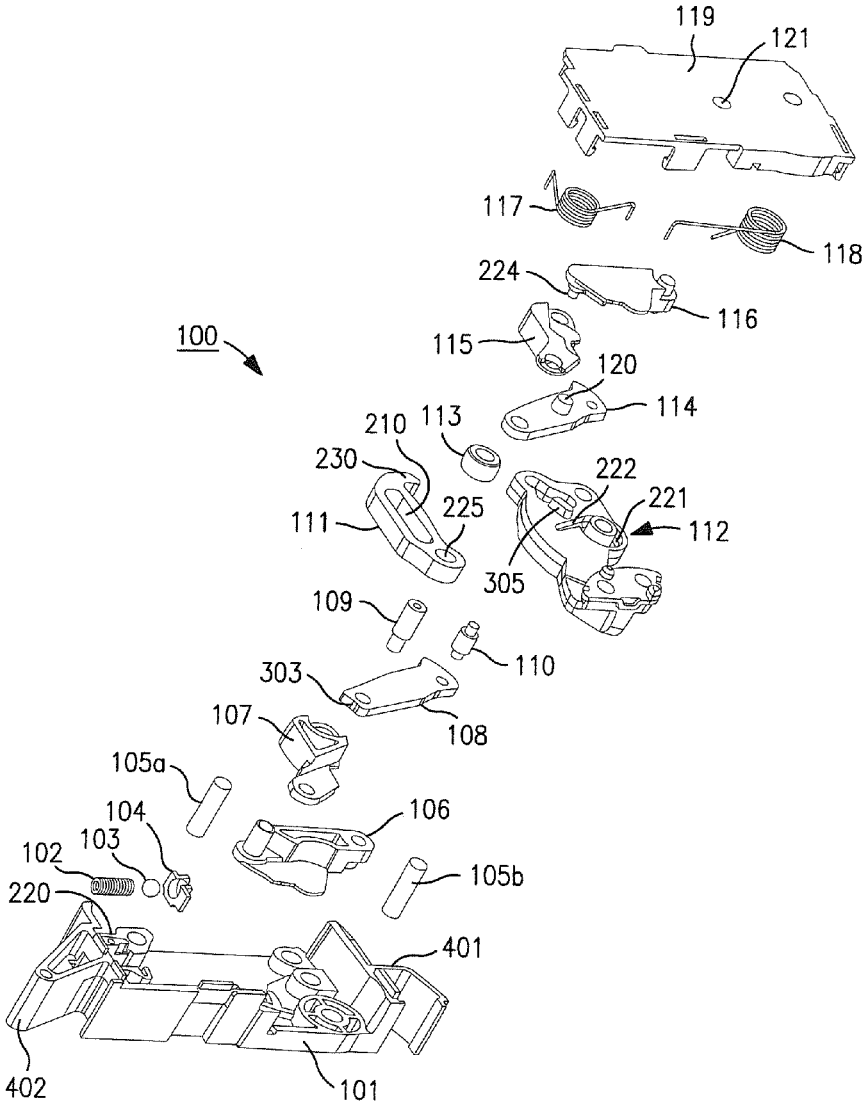
FIG. 13 is a perspective exposed view of the latch components.

FIG. 13 is a perspective exploded view of the latch showing its components. Shown is a top housing member 119 and a bottom housing member 101 and two interacting linkages, which for the purposes of describing the function of the latch 100 will be known as the main (drive) linkage, and the release linkage.

The main/drive linkage has a pawl operation housing pivot pin 105*a*, a lever handle operation housing pivot pin 105*b*, an upper main/drive link 108, a pawl pivot pin 109, a handle pivot pin 110, a pawl 111 with a hooked end 230, a lever handle 112, a lower main/drive link 114, a main/drive linkage biasing spring 117, and a lever handle biasing spring 118. The housing pawl operation pivot pin 105*a* and housing lever/handle operation pivot pin 105*b* are rotational fits in the bottom housing member 101 and the top housing member 119, and provide motion constraints for the pawl 111 and lever/handle 112. Link 108 and link 114 pivot about their mid-points each being rotationally constrained between the bottom housing member 101 and top housing member 119. The pawl pivot pin 109 and lever/handle pivot pin 110 are rotationally constrained at opposite ends between the link 108 and the link 114. The pawl 111 is rotationally constrained to the pawl pivot pin 109 and has a sliding/rotational fit to the pawl operation housing pivot pin 105*a*. The lever/handle 112 is rotationally constrained to the lever/handle housing pivot pin 105*b* and has a sliding/rotational fit to the handle pivot pin 110.

This arrangement enables a controlled linear and rotational transformation of the pawl 111 in relation to bottom housing member 101, through an angular movement of the lever/handle 112 about the lever/handle operation housing pivot pin 105*b*. The main/drive linkage spring 117 provides a bias to the main linkage 108, 112, driving it to either extreme of its available motion, while the lever/handle biasing spring 118 provides a bias to the lever/handle 112, driving a rotation about lever/handle housing pivot pin 105*b*.

The arrangement of the linkage and geometry of the components ensures that at one extreme the main/drive linkage can only be driven via the lever/handle 112, henceforth known as being in the locked position, while at the other extreme, the main linkage cannot be driven by lever/handle 112, henceforth known as being in the open position.

The release linkage consists of lower fixed pivot link 106, a lower floating pivot link 107, a bearing 113, an upper floating pivot link 115 and a upper fixed pivot link 116. The link 106 and the link 107 are rotationally constrained at one end between bottom housing member 101 and top housing member 119, while their other ends are rotationally constrained to link 107 and link 115 the pin position of which is movable. The other ends of link 107 and the link 115 are rotationally constrained to the pawl pivot pin 109 in the main/drive linkage.

The bearing 113 is a rotational fit to link 106 and acts as a roller to reduce friction between any surfaces it comes into contact with. This release linkage provides a means of moving the main/drive linkage from its extreme open position.

Both linkages are constrained between the bottom housing member 101 and top housing member 119, which provide the only mechanical fixings for the whole latch assembly 100. Each of the upper main/drive link 108 and the lower main/drive link 114 have a stub shaft 120 which extends through a stub shaft journal hole 120 in the respective adjacent outer face of the upper and lower housing members. This provides the central pivot point for these two links Further, an arrangement consisting of a detent spring 102, a steel ball 103 and detent retainer 104 provide an intermediate stop/detent position between the locked and open positions of the main linkage. This structure provides a physical indication that the lever has moved from the full closed/locked position to an intermediate position where opening is about to begin. The detent retainer 104 is pressed into the bottom housing member 101, as an interference fit, forming a retaining feature for a steel ball 103, which is biased in place by the detent spring 102.

The main drive link spring 117 is a torsion spring with two arms each with a downward pointed end (foot). One end of the spring 117 is pinned to the bottom housing member 101 at a fixed point 220 and the other end of the spring 117 is pinned to the pivot point pin 109 between the main/drive links 114 and 108. This permits the spring 117 to float between different positions.

The lever/handle biasing spring 118 is a torsion spring with one short straight arm and a longer arm with a downward extending pointed end (foot). This spring 118 sits in a torroid-shaped cavity 221 in the top face of the lever/handle 112, a short radial extending slot 222 extend from the torroid cavity 221. The short leg of the spring 118 sits in the slot 222 while the coil of the spring 118 sits in the torroid-shaped cavity 221. The longer arm of the spring 118 has its downward end secured to a receiving hole 223 in the adjacent sidewall casting of the bottom housing member 101.

The latch 100 essentially has three, two-piece links. The links are structured with top and bottom members being a "pair" so that they may be separated to install, i.e., receive the respective pivot pins. One paired release link 106, 116 has a fixed housing pin 105*b* and a floating pin 224 tying it to the second paired release link 107, 115.

The other end of the second link 107, 115 is pinned 225 to the end of the pawl and the main/drive link 108, 114 with the pawl pivot pin 109 into which one end of the main/drive linkage spring 117 fits its upper arm downward leg. The opposite end of the main/drive links 108, 114 is each tied to the lever/handle 112 having the elongate cavity 226 with the side recess 227. The lever/handle 112 rotates counter clockwise to open the latch and clockwise when the latch is being closed.

Figure 14:
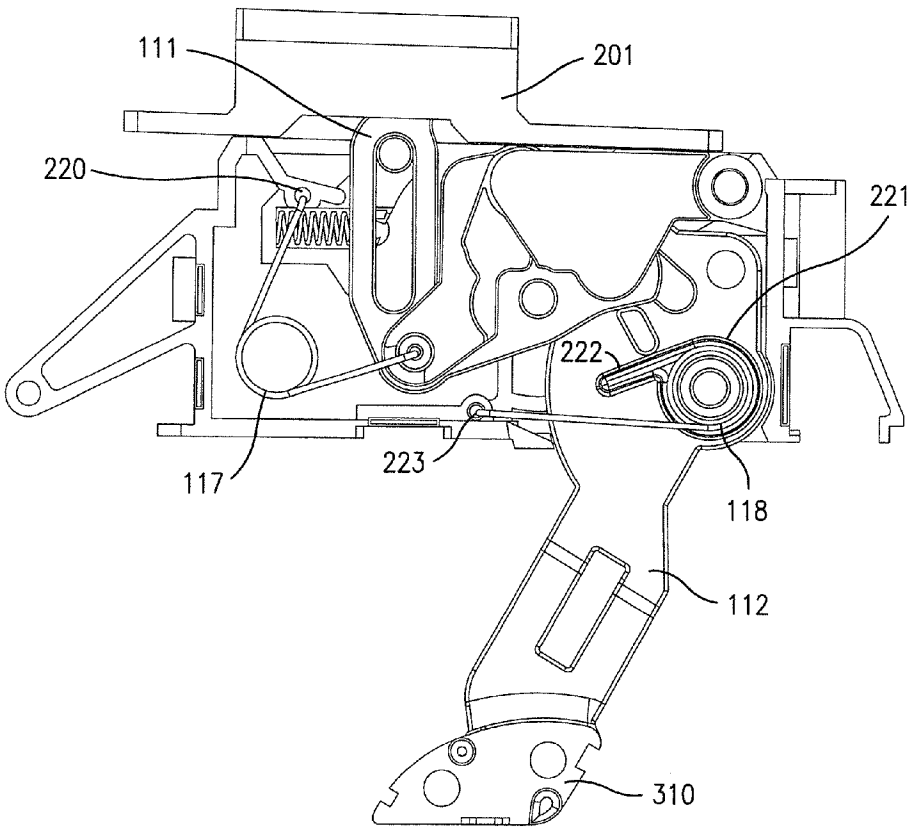
FIG. 14 is a plan/top view of the latch with the top of the housing removed and the latch in the closed position engaging the keeper/striker.
Figure 15:
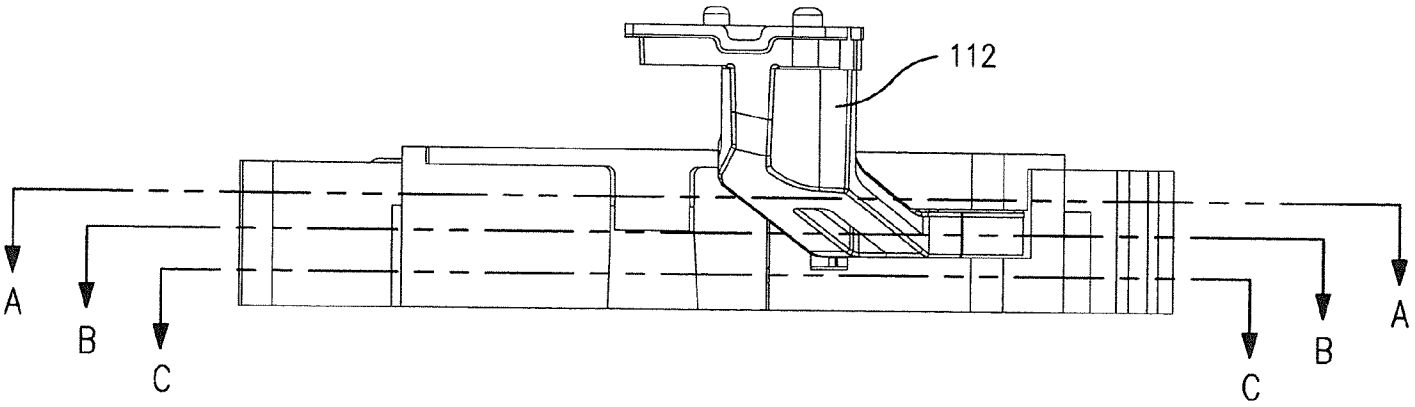
FIG. 15 is a front view of the latch of FIG. 14 in the closed position showing sectional cuts A, B, and C.
Figure 16:
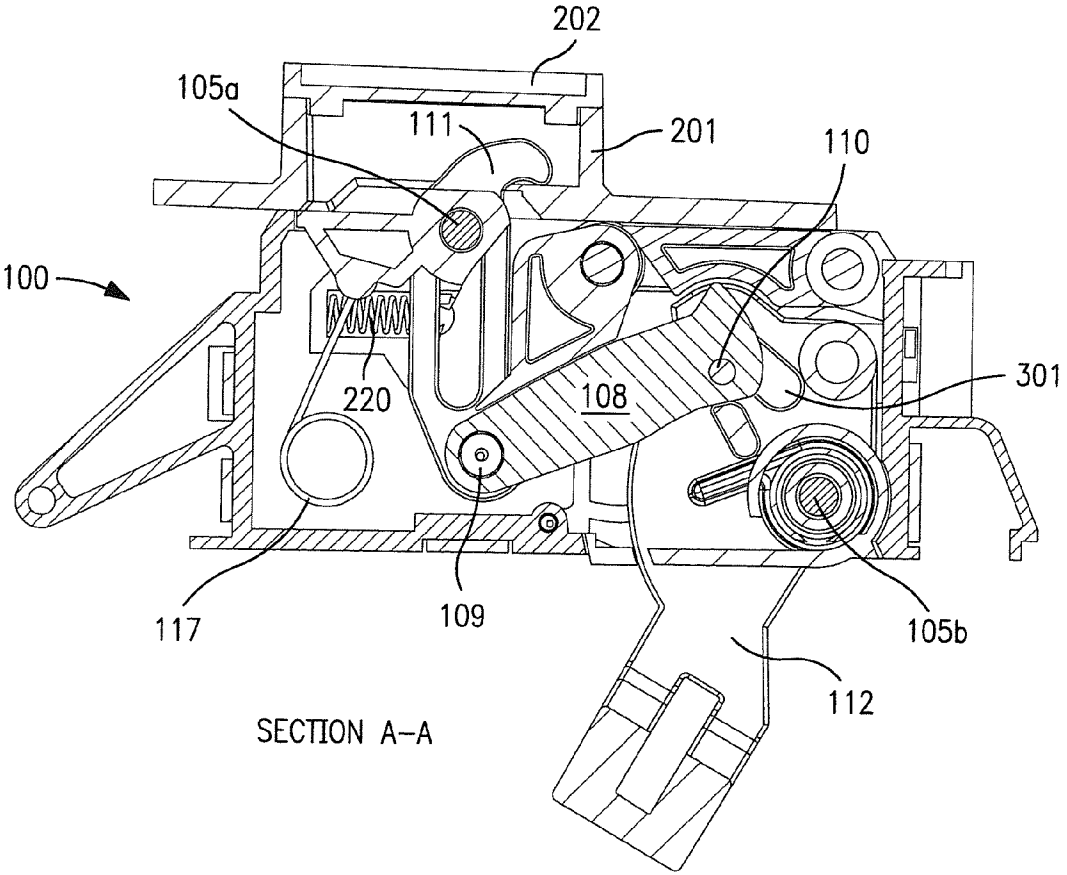
FIG. 16 is a plan/top view of the closed latch of FIG. 15 at section A-A.

FIG. 14 shows a plan/top view of the latch 100 in the closed position with the pawl 111 engaging the keeper/striker 201. The spring 117 has its downward leg engaging a point 220 on the bottom housing. The handle spring 118 has one leg engaging a bottom housing receiving hole 223 and the other leg positioned within a slot 222 in the lever handle 112. FIG. 15 shows a front view of the latch handle 112 extending outwardly (from a door) when the latch 100 is in the closed position showing sectional cuts A, B, and C through the latch 100. FIG. 16 shows the closed latch 100 engaging the keeper striker 201 with it pawl 111 hooked finger portion 230.

Figure 17:
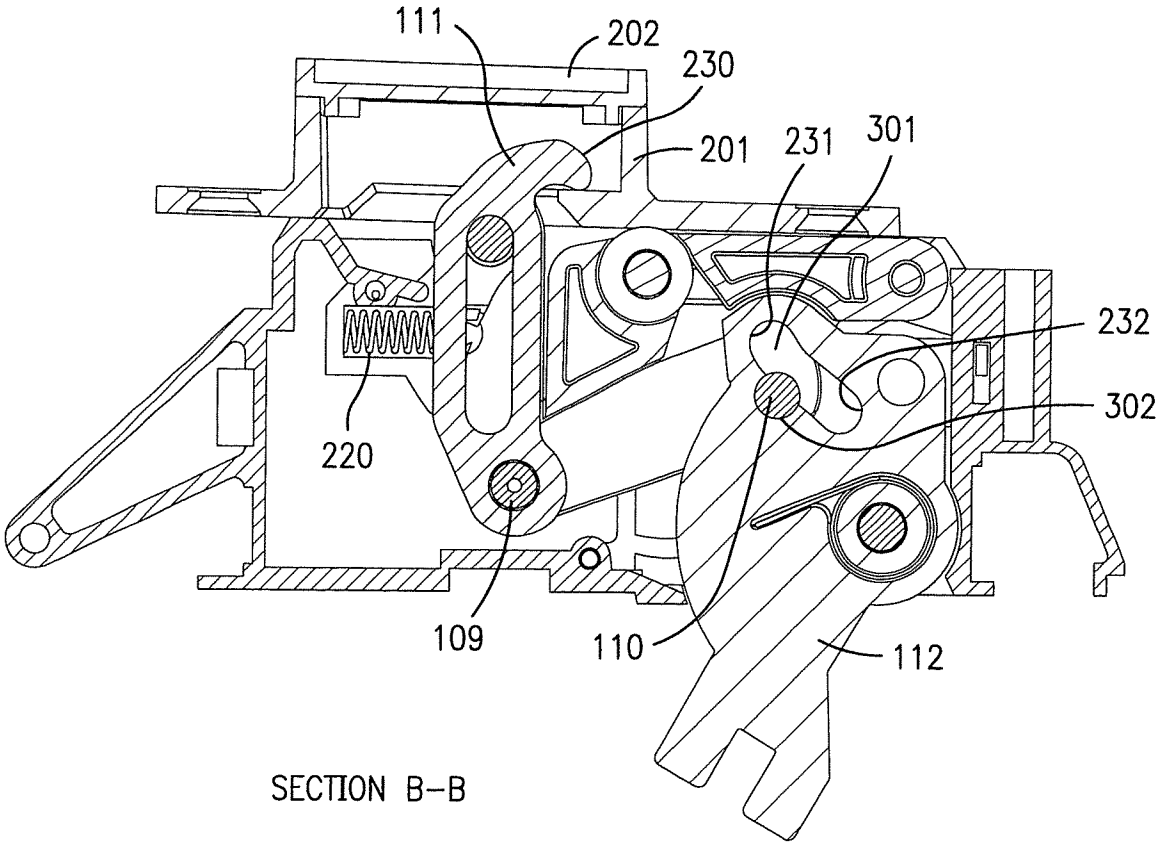
FIG. 17 is a plan/top view of the closed latch FIG. 15 at section B-B.
Figure 18:
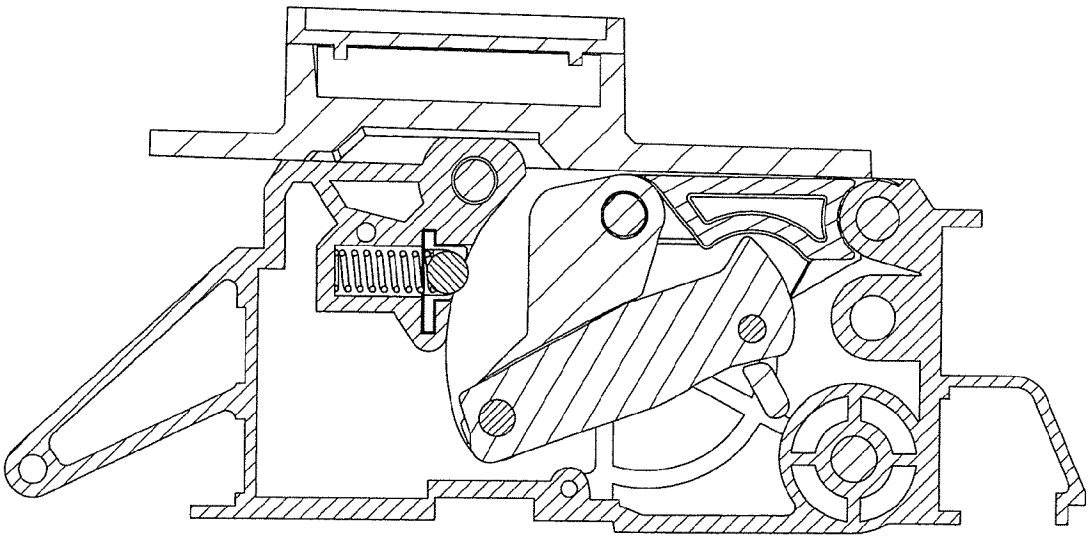
FIG. 18 is a plan/top view of the closed latch FIG. 15 at section C-C.
Figure 19:
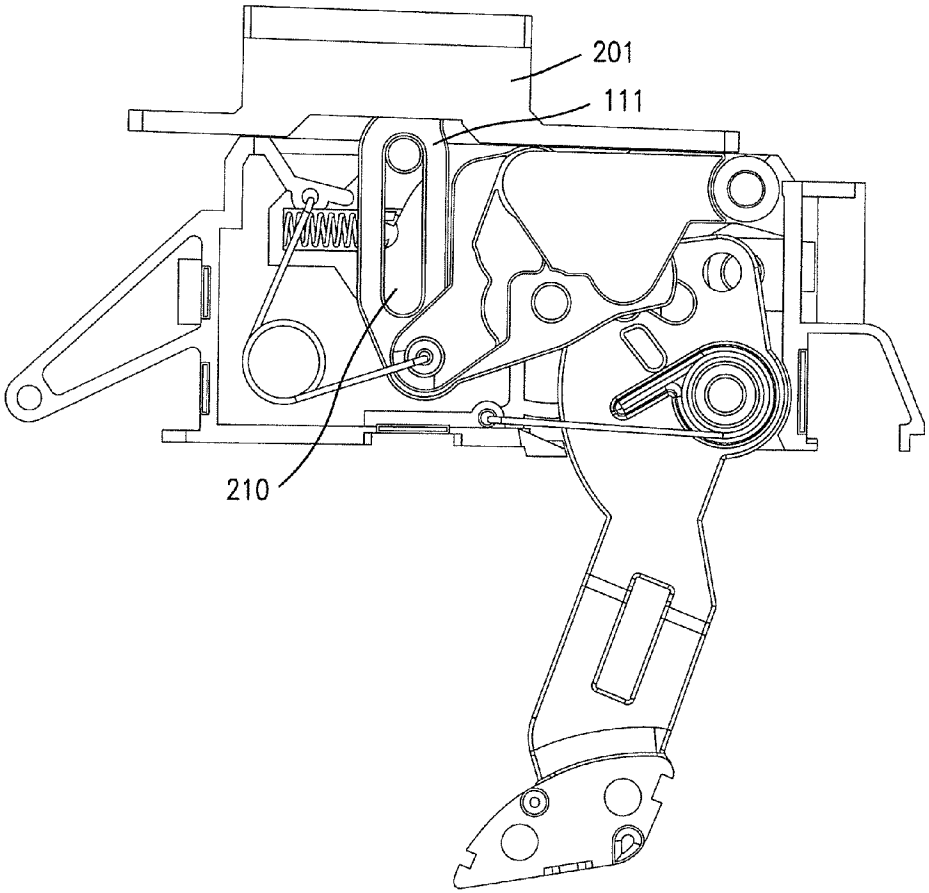
FIG. 19 is a plan/top view of the latch with the top of the housing removed and the latch in the engaged position with the hooked finger of the pawl within the cup portion of the keeper/striker.
Figure 20:
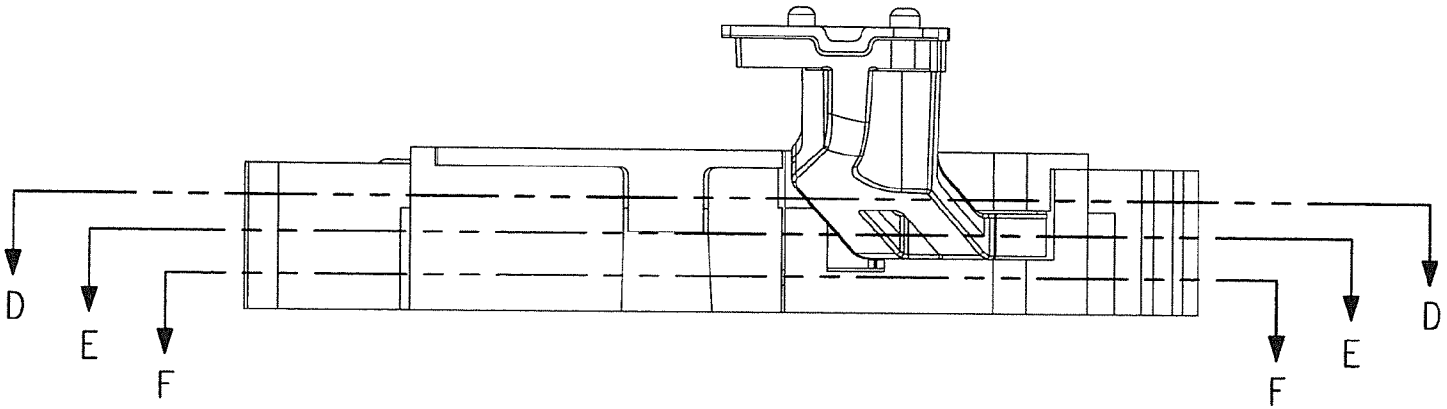
FIG. 20 is a front view of the latch of FIG. 19 in the engaged position showing sectional cuts D, E and F.
Figure 21:
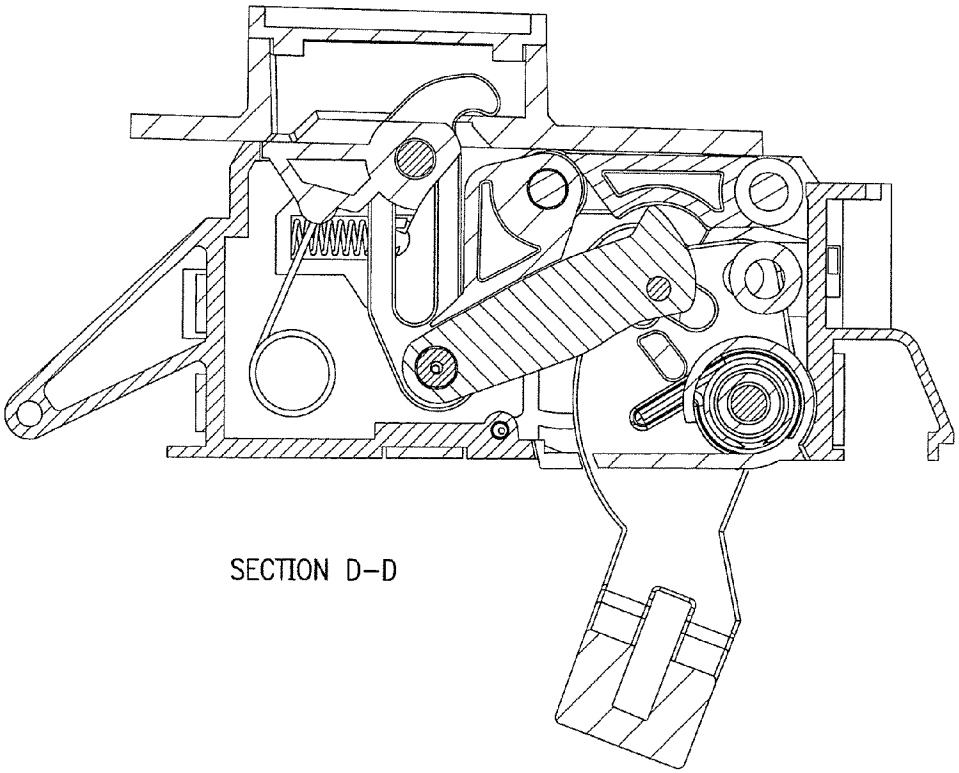
FIG. 21 is a plan/top view of the engaged latch of FIG. 20 at section D-D.

FIG. 17 illustrates the hold closed position where the drive link pin 110 is held in the side recess 302 of the three lobed guide slot 301. This slot 301 has a main slightly curved portion which is formed by a left lobe area 231 and a right lobe area 232, which actually operates as a cam guideway for the pin 110 which operates as a cam follower. The side recess 302, in the middle, holds the pin 110, FIG. 17, when the latch is in the extreme closed position. This is really a stop or detent-hold position, establishing a final clockwise rotation position for the lever/handle 112. It also prevents link 108 and link 114 from rotating in a clockwise rotation. This in turn prevents the pawl 111 from moving, thus holding any compressive load generated between the latch and the keeper.

FIGS. 19, 20, 21, 22, and 23 show different sectional cut views of the latch 100 in the engaged position. The engage position is where the hooked finger 230 still engages the cup of the keeper/striker 201 to hold the door 501 closed and the gasket 323 still compressed, but the latch 100 is about to open.

Figure 22:
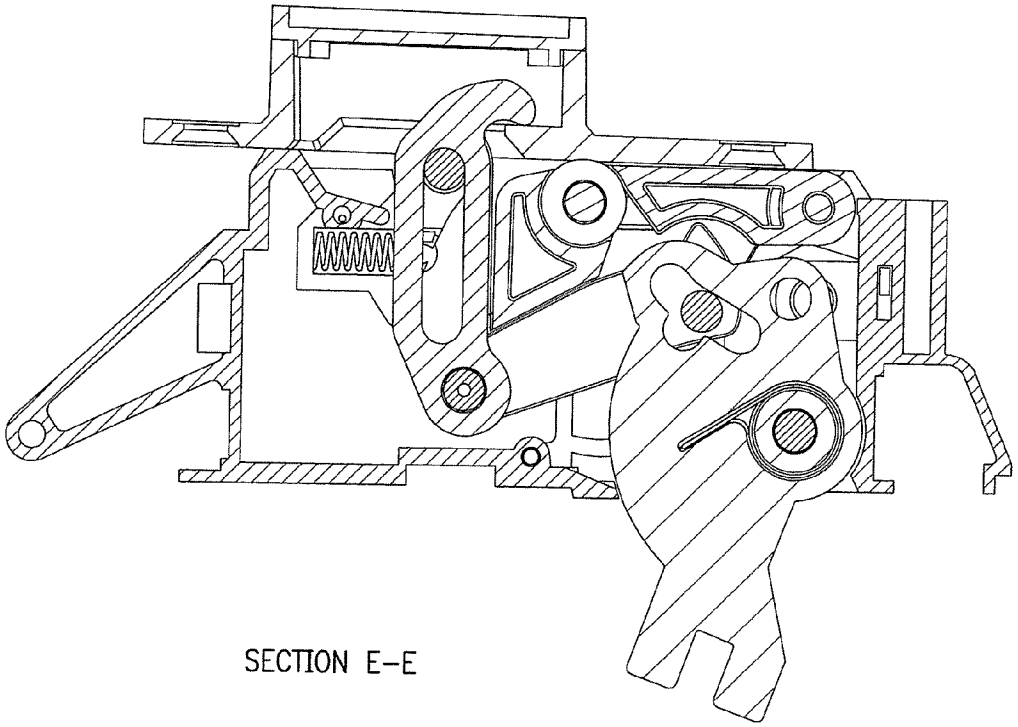
FIG. 22 is a plan/top view of the engaged latch of FIG. 20 at section E-E.
Figure 23:
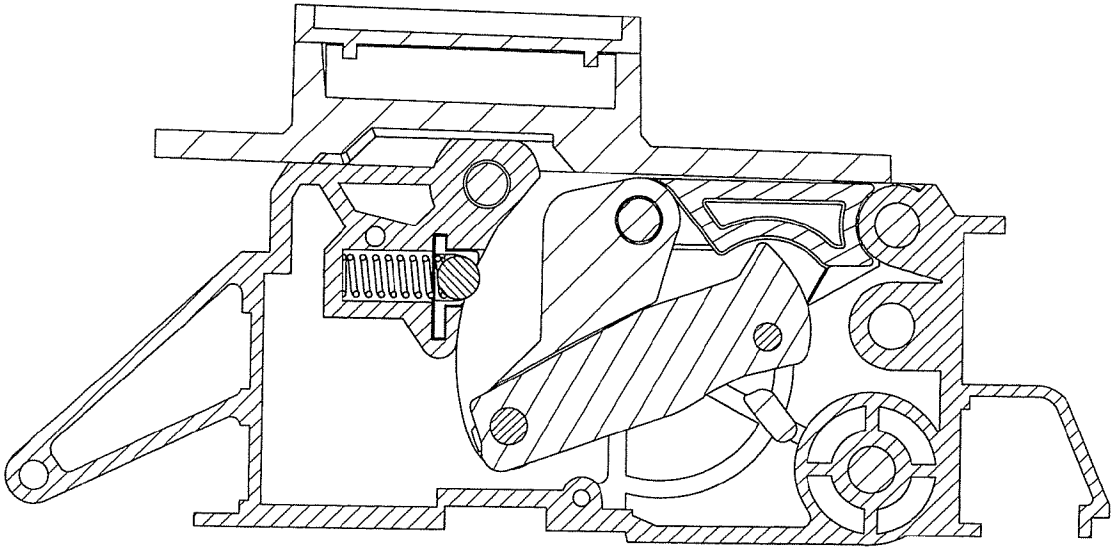
FIG. 23 is a plan/top view of the engaged latch of FIG. 20 at section F-F.

In the engaged position, as shown in FIG. 22, the lever/handle 112 has been freely rotated counterclockwise about 10 degrees, at which point it provides a resistance indication, indicating that the latch while still closed is about to open. This resistance indication arises because the cam follower, i.e., pin 110, is moved out of the side recess 302 to come into contact with the far side of the guide slot 301, FIG. 22. But as the pin 110 moves out of the side recess 302, the links 108, 114 and the pawl 111 will be free to move, releasing any compression generated between the latch and the keeper 201.

In normal use, rotating the handle though the initial 10 degrees releases the compression, which moves the main linkage 108, 114, the pawl pivot pin 109, the handle pivot pin 110 and the pawl 111 to an indeterminate position where the pin 110 will move someway into the right hand lobe of the guide slot 301 in the handle 112, coming to rest when the compression force is reduced to zero.

As the lever/handle continues to rotate counterclockwise, the pin 110 is caused to move by the slot towards the right lobe. This action will start to rotate the link 108 clockwise which in turn will push the pawl 111 outwardly, being guided by its pawl slot 210 operation with the pawl operation housing pin 105*a*. The secondary linkage 106, 107, 115 and 116 is also moving during this time and can assist the operator in overcoming any resistance or restriction caused by the gasket 323 taking a set and preventing the door form opening.

FIGS. 24, 25, 26, 27 and 28 show different sectional cut views of the latch 100 in the detent position.

Figure 27:
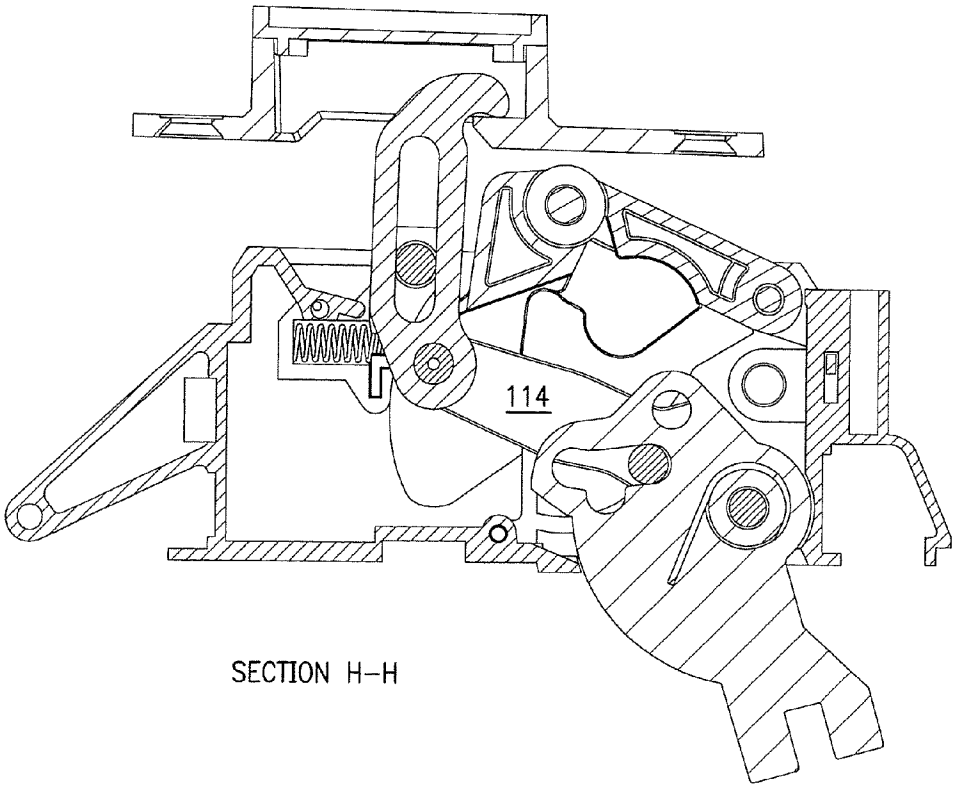
FIG. 27 is a plan/top view of the detented latch of FIG. 25 at section H-H.

When cam follower, pin 110, is fully in the right lobe, because the lever/handle 112 has been rotated counterclockwise about another 15 degrees, the detent position is attained, FIG. 27. At this point there is sufficient resistance/friction in the mechanism to overcome the forces from the springs 117 and 118. So in normal use, the user can move the lever/handle 112 counterclockwise to the stop caused by the detent feature. If the lever/handle 112 is released by the user at this point, it should remain in this position. This is to enable the door to be left ajar to release any pressure, steam or other gas from the inside of the enclosure while the pawl 111 remains engaged with the keeper 201.

Figure 28:
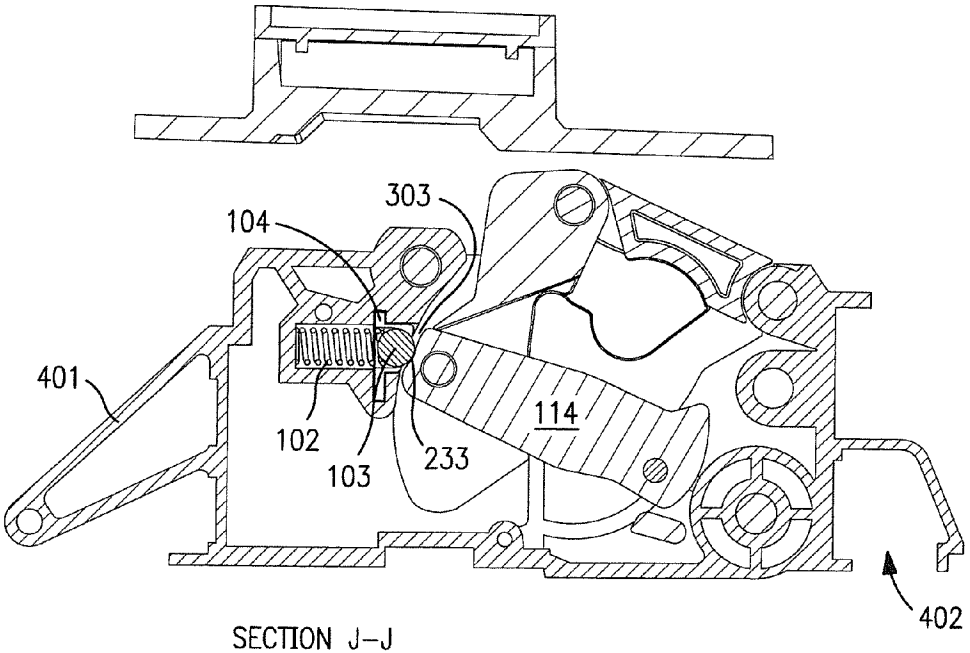
FIG. 28 is a plan/top view of the detented latch of FIG. 25 at section J-J.

In the full detent position, the detent ball 103 is driven by the detent spring 102 and guided by the detent retainer 104 to contact the detent feature (dimple) 303 in the end of the main drive link 108, FIG. 28. This establishes the full lateral (straight outwardly transition) movement of the pawl, FIG. 27 where the latch and the door is held in the "cracked-open" position shown in FIG. 2. In FIG. 27 the pawl 111 is shown in its fully outwardly extending position. The further movement of the pawl will be a counterclockwise rotation about its housing pin 105*a*. This is only a transitional position. It is not intended that the latch can be left in this position as the "vent" position is the one recited above.

Figure 24:
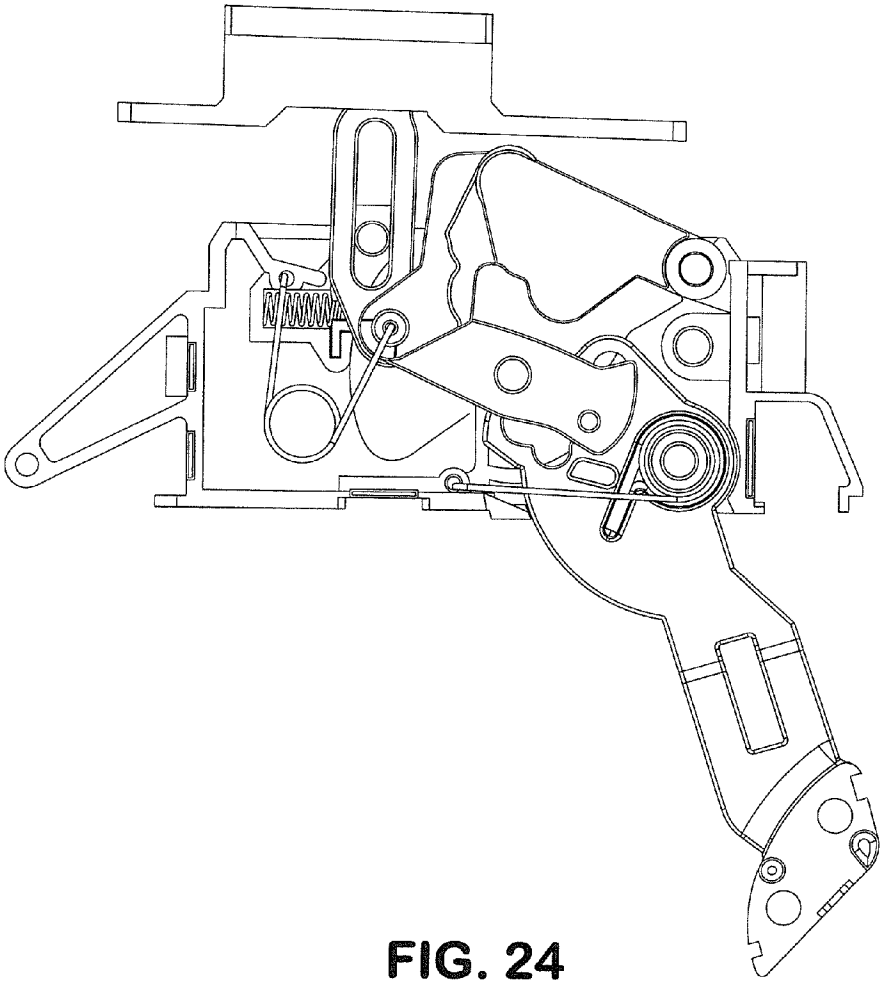
FIG. 24 is a plan/top view of the latch with the top of the housing removed and the latch in the detent position.
Figure 25:
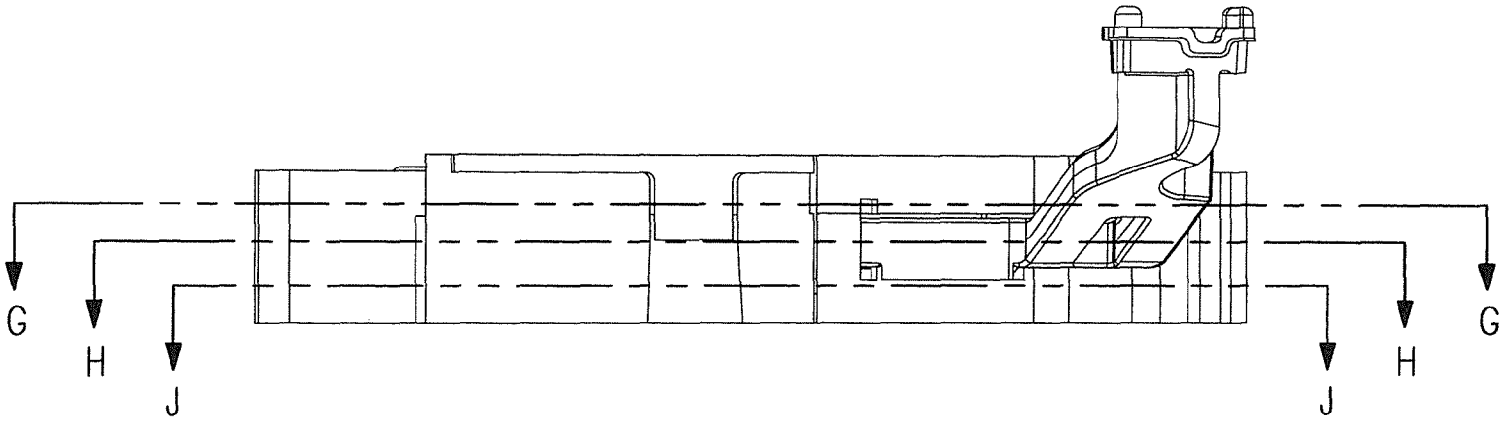
FIG. 25 is a front view of the latch of FIG. 24 in the detent position showing sectional cuts G, H and J.
Figure 26:
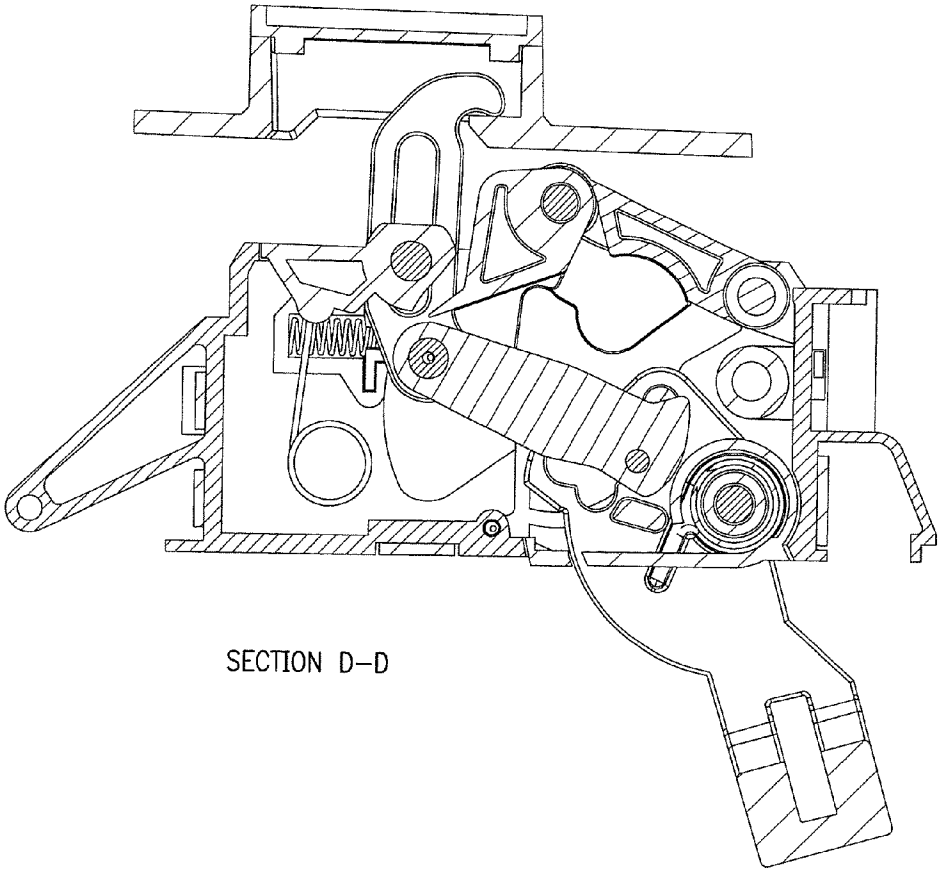
FIG. 26 is a plan/top view of the detented latch of FIG. 25 at section G-G.
Figure 29:
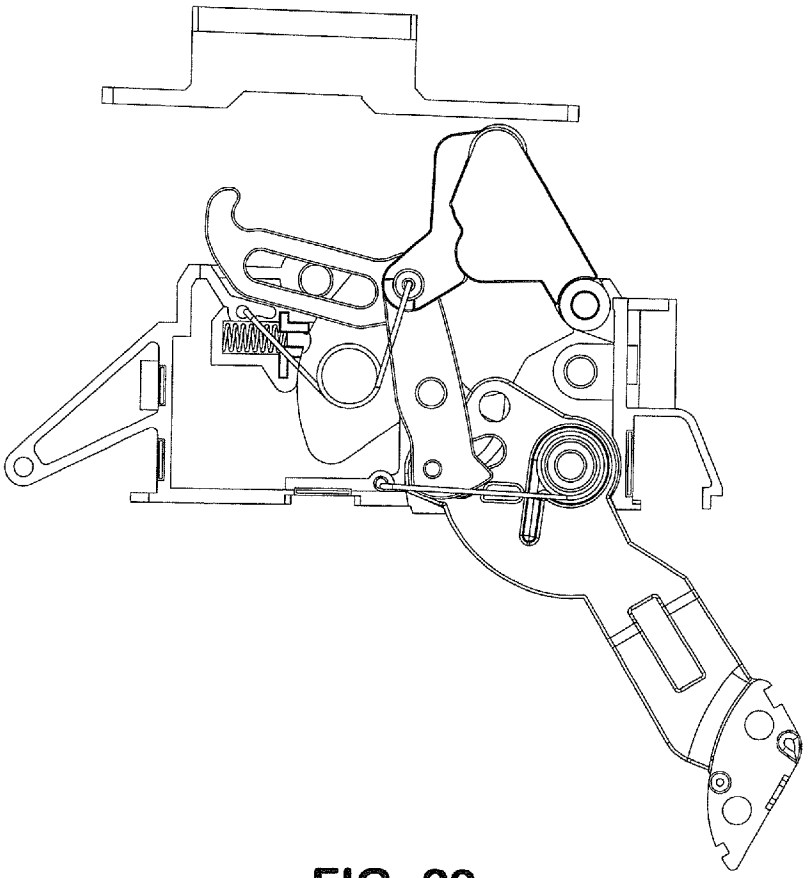
FIG. 29 is a plan/top view of the latch in the extreme open position.
Figure 30:
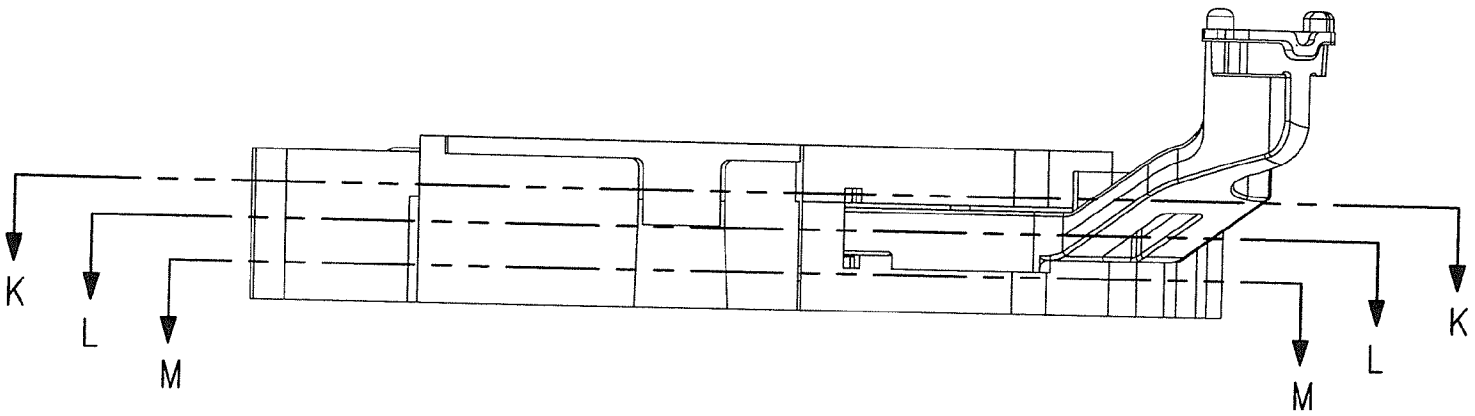
FIG. 30 is a front view of the latch of FIG. 29 in the open position showing section cuts K, L and M.

The further counter clockwise rotation of the lever/handle 112 brings the latch to the open position, FIG. 29, where the pawl 111 is fully counterclockwise rotated into the housing (about 75 degrees). In this position the lever/handle 112 cannot rotate counterclockwise further because its right edge abuts the bottom housing member 101 wall, FIGS. 29 and 31. FIGS. 29, 30, 31, 32 and 33 show the latch 100 in different sectional cut views in the extreme open position with the lever handle 118 held fixed from movement by the detent operation of the ball 103 against the detent indentation of the lower main drive link 114, shown in FIG. 28. FIG. 24 shows a plan view of the latch 100 where the detent ball 103 (shown in FIG. 28) engages the detent indentation 233, and holds the lever handle 112 positively in the fully open position.

As shown in FIG. 28, the detent spring 102 exerts a force against the detent retainer 104 which holds the detent ball 103 to engage the detent indentation (depression) 233.

Figure 32:
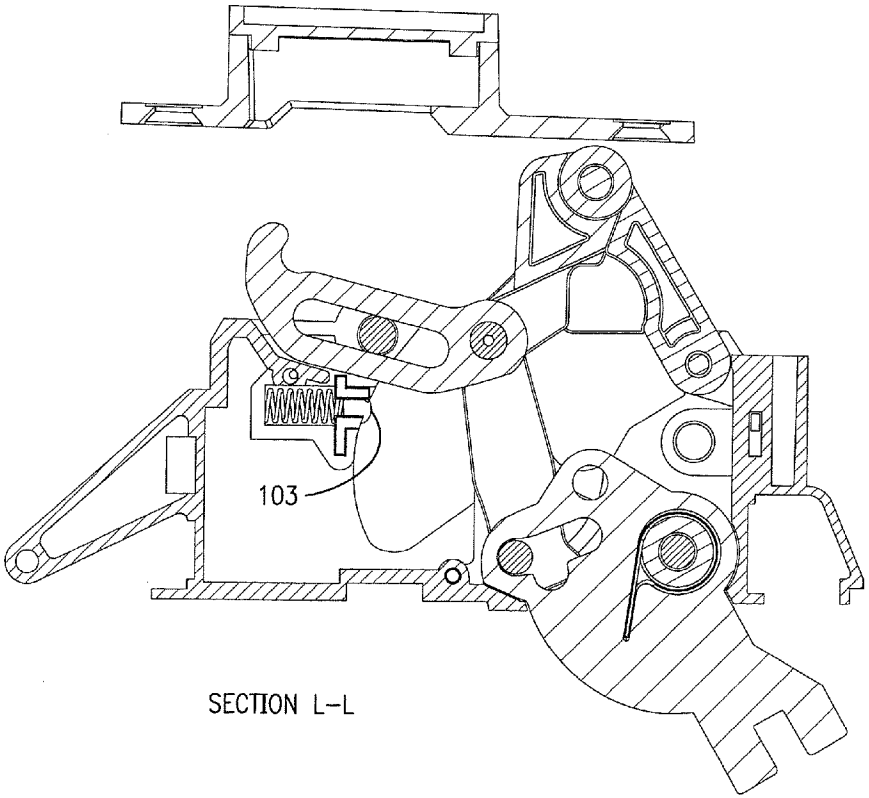
FIG. 32 is a plan/top view of the open latch of FIG. 30 at section L-L.

The lever/handle 112 and thereby the latch 100 is held in the open position with the cam pin 110 fully in the left lobe of the guide slot 301, FIG. 32. In this position, the end of the main/drive link 114 abuts the abutment shoulder 305 on the handle, FIG. 33. It is the pin 110 located within the left hand lobe of the guide slot 301 which prevents the lever/handle 112 from rotating. The abutment shoulder(s) 305 on the lever/handle 112 are only required during the latch closing movement, interacting with the end of the main/drive links 108, 114 to prevent the pin 110 from entering the side recess 302 of the guide slot 301 in the lever/handle 112 which would cause the mechanism to lock up.

Figure 31:
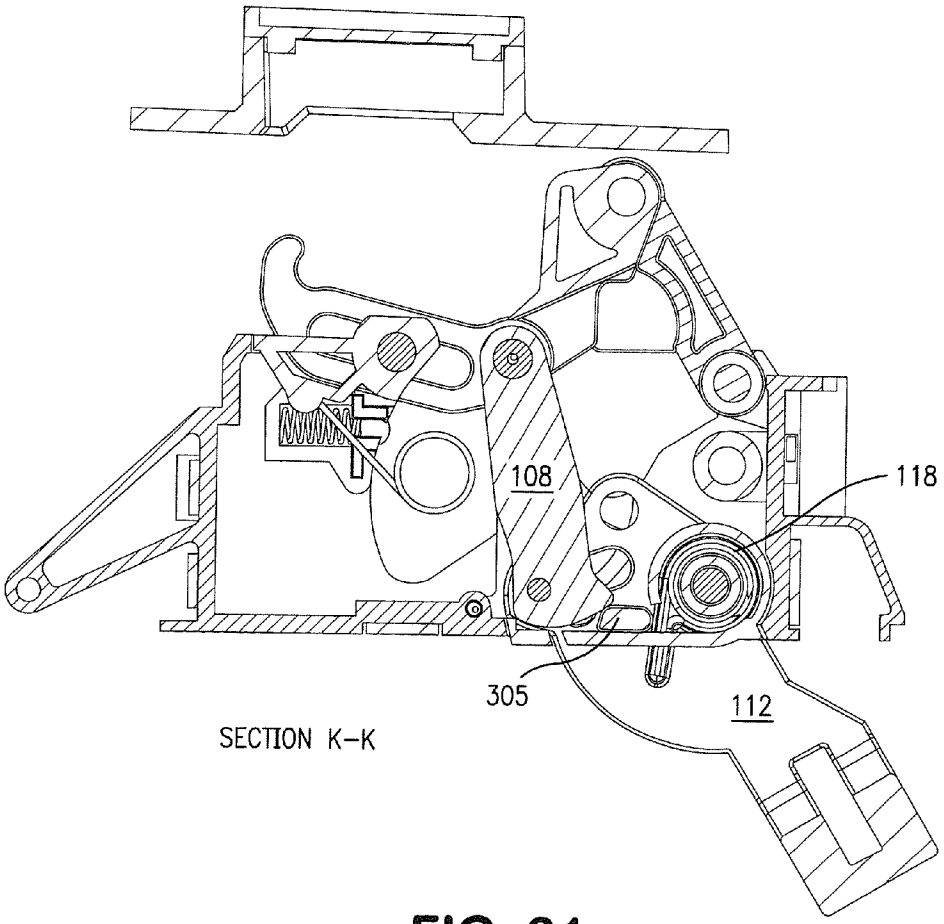
FIG. 31 is a plan/top view of the open latch of FIG. 30 at section K-K.
Figure 33:
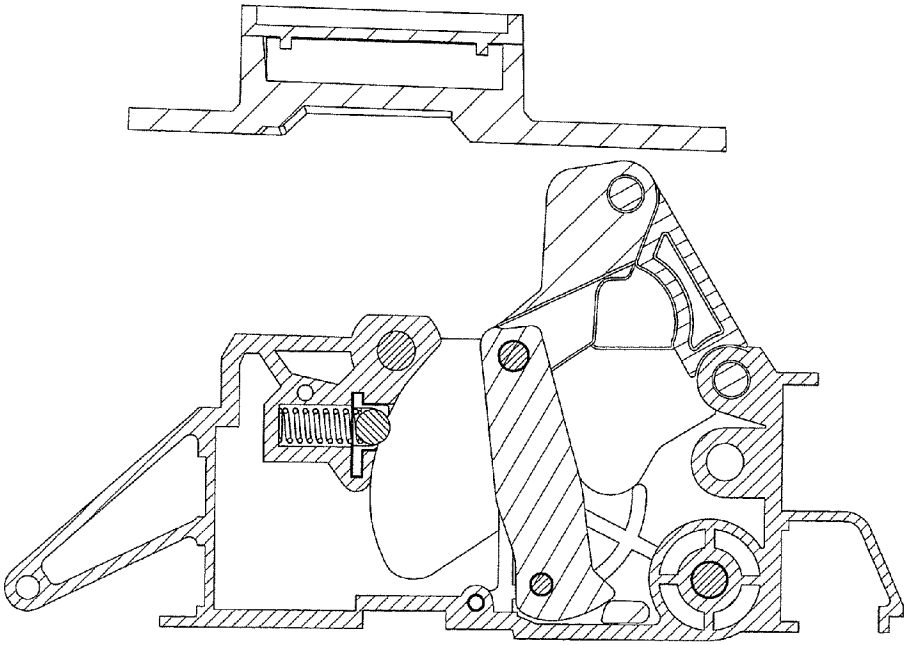
FIG. 33 is a plan/top view of the open latch of FIG. 30 at section M-M.
Figure 34:
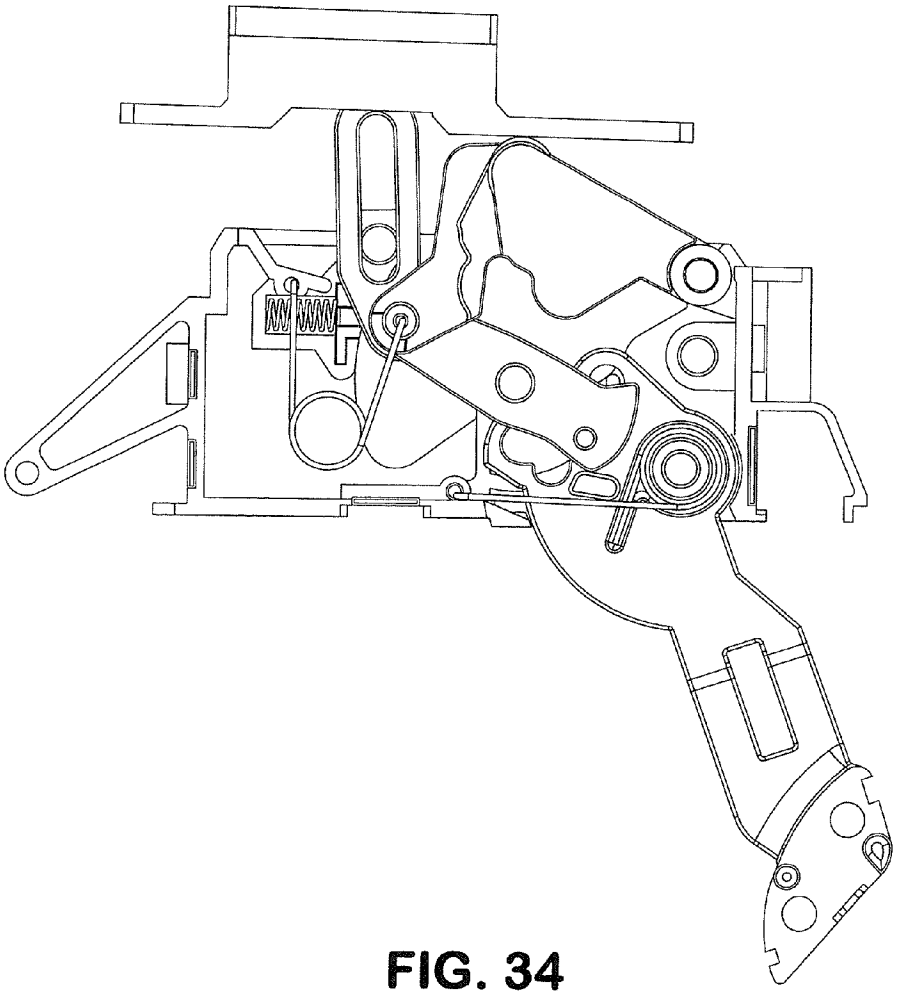
FIG. 34 is a plan view of the latch with the tip of the housing removed and where the detent ball is in the depressed position where the pawl continues to be extended into the keeper and the release links are beginning to extend.
Figure 35:
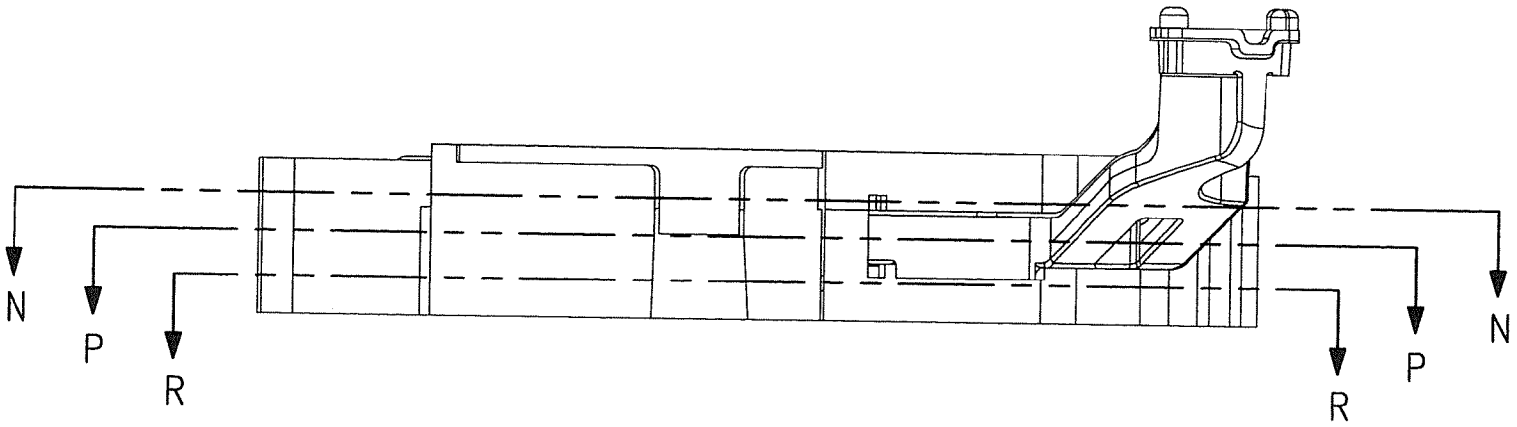
FIG. 35 is a front view of the latch of FIG. 34 in the detent ball depressed position showing section cuts N, P and R.
Figure 36:
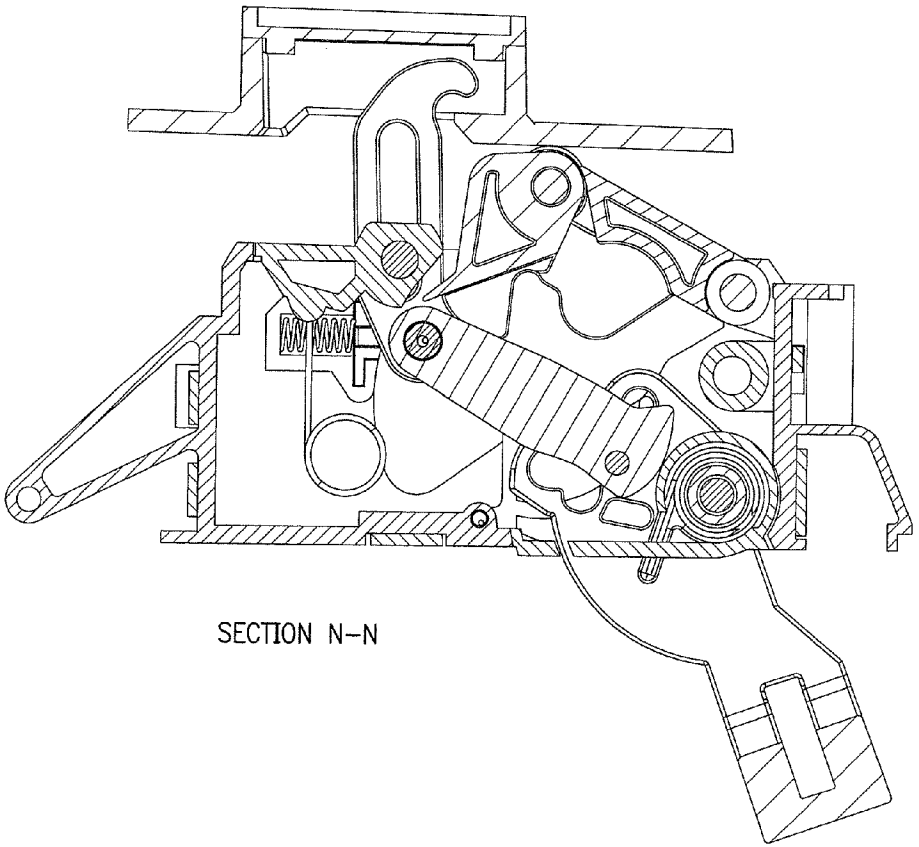
FIG. 36 is a plan/top view of the latch of FIG. 34 at section N-N.
Figure 37:
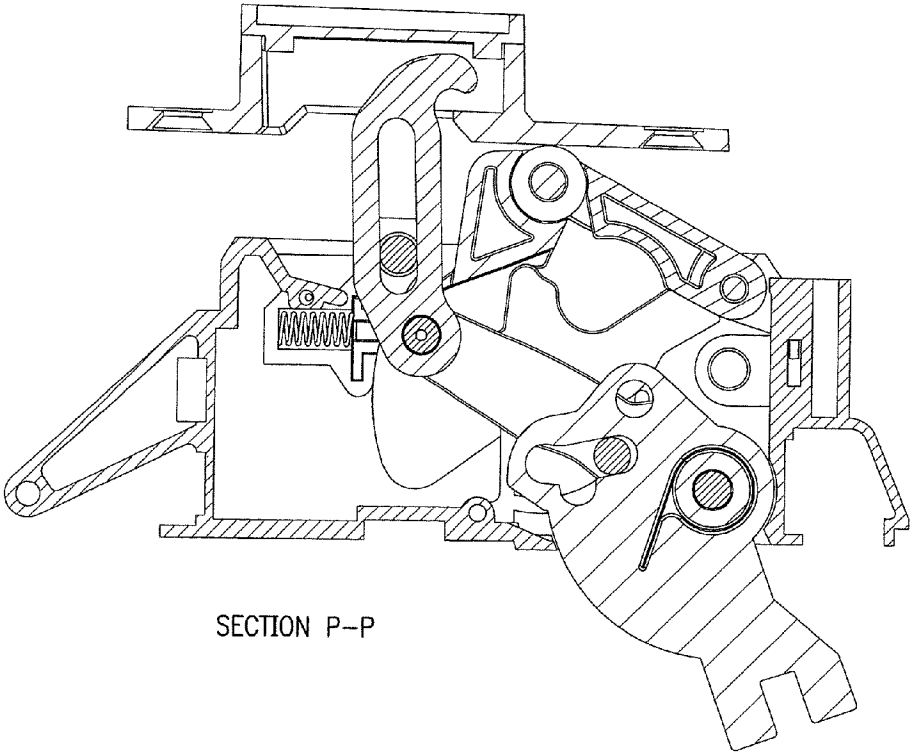
FIG. 37 is a plan/top view of the latch of FIG. 34 at section P-P.
Figure 38:
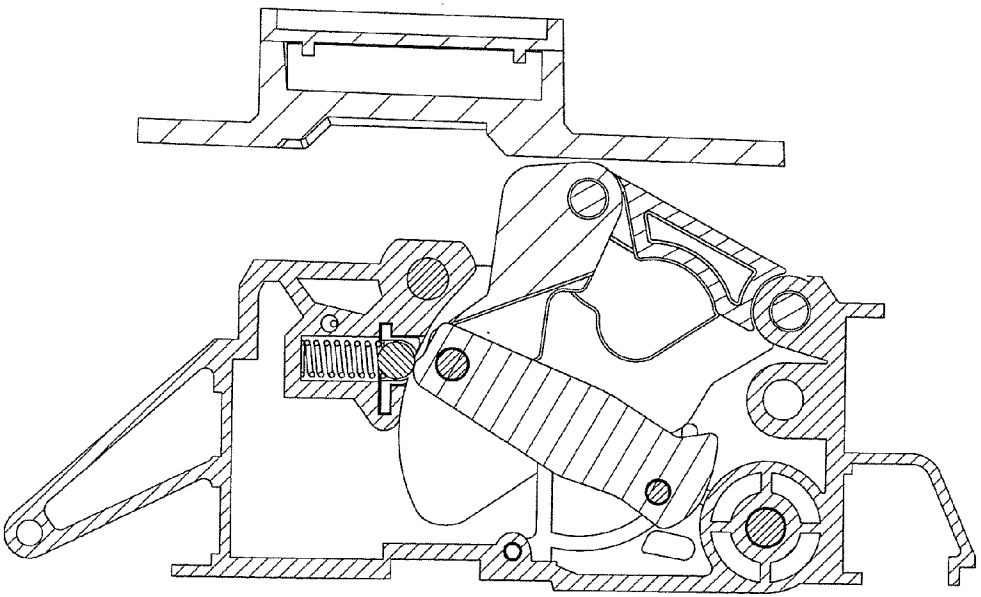
FIG. 38 is a plan/top view of the latch of FIG. 34 at section R-R.

However, FIG. 33 does not show the lever/handle 112 as it is the lower link 114 which abuts the shoulder 305. The upper main/drive link 108 is shown in FIG. 31 and the lower link 114 is shown in FIGS. 32 and 33.

The benefit of the fixed pivot points is that they constrain a component's motion to one degree of freedom, thus enabling precise control of their movement. Controlled linear and angular displacement can only be achieved through either floating pivots, and/or sliding joints, although using a round pin within a slot enables a joint to slide and pivot within the same feature.

The floating main spring 117 ensures that the pawl 111 completes its full travel during either opening or closing, wherein the latch needs to change from one state to another without relying upon the operator. Thus, during opening, once the handle is rotated passed the detent position, the main spring 117 will drive the mechanism form the detent state to the fully open state without further movement of the handle.

During closing, the release linkage will push the main/drive linkage from the fully open state, through the detent state, where the main spring 117 will drive the main/drive linkage to ensure the pawl 111 is fully engaged with the keeper 201. This ensures that the pawl does not unintentionally clash with the keeper. The detent state has been set to coincide with the "flip point" of the main mechanism so that the force required to hold the mechanism in that position is at it lowest despite the force being generated by the floating main spring 117 being at its greatest.

This is because the fixed end of the floating spring, the pivot point at the center of the pawl pin 109 and the center of ration of the main/drive links 108, 114 are collinear at this point. Rotation of the main/drive links 108, 114 in either direction will move the pawl pin 109 out of line with the fixed end of the floating spring and the center of rotation of the drive links 108, 114. The force of the floating main spring 117 will drive the rotation of the main/drive links 108, 114 further in that direction. This effect can be achieved by another mechanism, but that would require springs to be located on or within one of the moving components, thereby requiring them to be larger, more expensive to produce and more complicated to assemble.

FIGS. 35, 36, 37, and 38 show different sectional cut views of the latch 100 held in the detent state.

Figure 39:
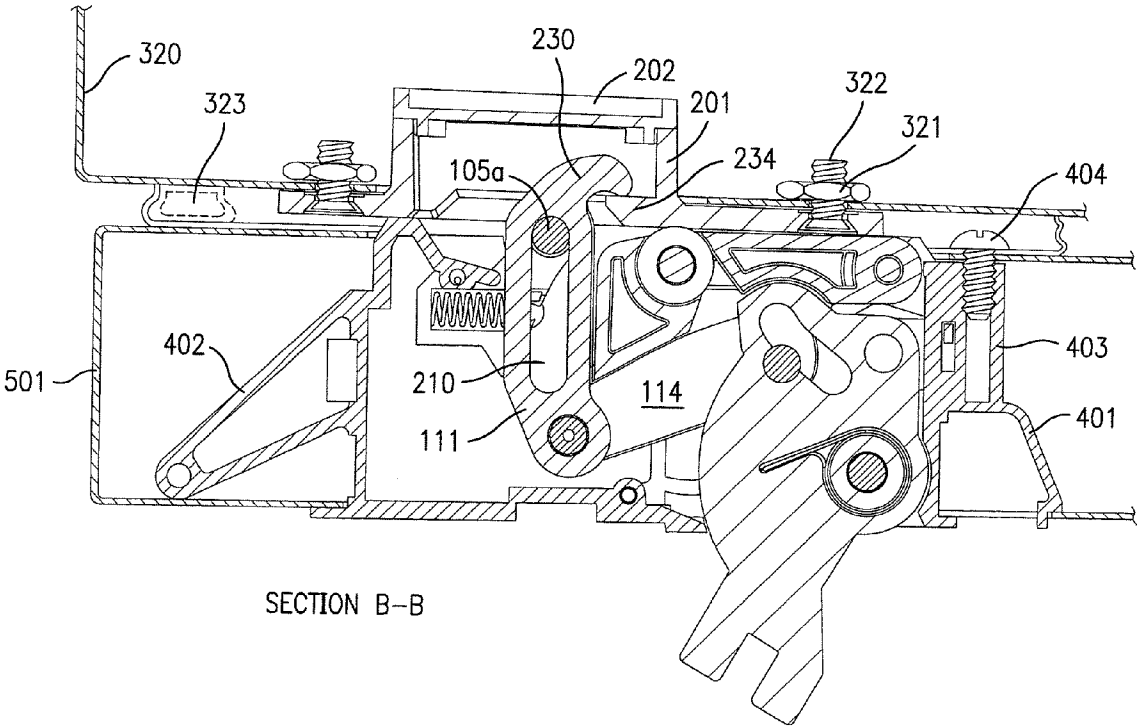
FIG. 39 is a plan/top view of the closed latch of FIG. 14 in the sectional view B-B of FIG. 17, but with the keeper/striker and its back plate mounted to a door jamb with mounting screws and nuts, and the gasket compressed, where the latch is positioned within the door.
Figure 40:
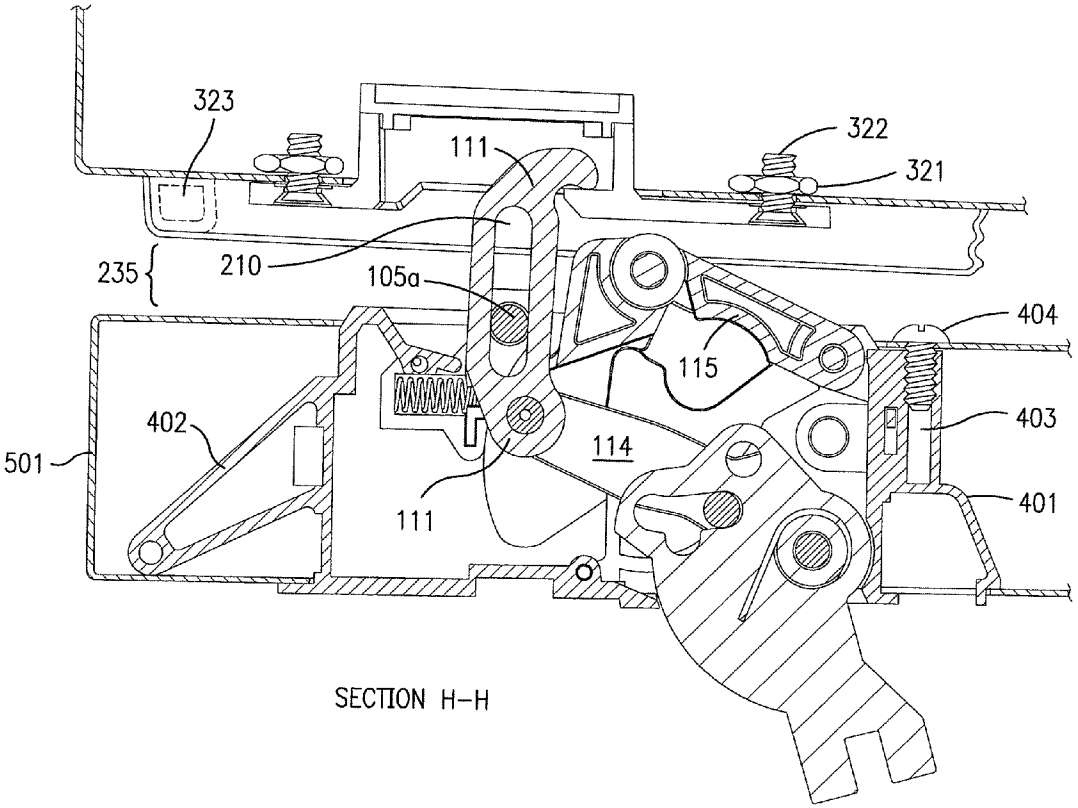
FIG. 40 is a plan/top view of the latch in the engaged detent position of FIG. 27 showing section H-H.

The keeper/striker 201 and its back plate 202 are held to the door jamb 320 with mounting screws 322 and nuts 321, FIGS. 39 and 40. In the fully engaged (locked) position, FIG. 39, the pawl 111 hooked end 230 is fully exerted against the cup lip 234 to compress the gasket 323. The travel of the pawl 111 is controlled by the operation of the cam pin 105*a* which operates within the pawl slot 210. In the fully engaged and gasket depressed state, the link 114 has pulled the pawl 111 fully into the housing so that the pin 105*a* abuts the keeper/striker 201 end of the pawl 111, FIG. 39, and the gasket 323 is fully depressed to the sealing state.

In the release state, the link 114 has rotated so that the pawl 111 has moved outwardly from the housing so provide a space 235 between the main body of the oven and the oven door. FIG. 40. In this state, the pin 109 has been moved along the pawl slot 210 and the push-out link 115 has started to rotate outwardly.

The latch is held in the door 501 by the spring clamp 402, on one side, and by the ear 401 having the channel 403 for receiving a mounting screw 404 which seats against the inside face of the door 501, on the other side.

Many changes can be made in the above-described invention without departing from the intent and scope thereof. It is therefore intended that the above description be read in the illustrative sense and not in the limiting sense. Substitutions and changes can be made while still being within the scope and intent of the invention.

What is claimed:

1. A lever operated compression latch for engaging a striker, comprising:

a housing;

a hook-ended pawl positioned within said housing and operative to extend therefrom to engage a striker;

a lever/handle having a cam slot and being rotatably mounted within said housing and having a portion extending therefrom;

a plurality of interconnected links connected to said lever/handle and to said pawl; wherein a first one of said links has a cam follower engaged with said lever/handle cam slot and a detent feature at one end thereof; and a detent ball positioned within said housing, wherein said cam follower and said cam slot cooperate to establish a closed, an engaged, a detent and an open states for said latch, and wherein said detent ball engages said first link detent feature in said detent state.

2. The latch of claim 1, wherein in said closed stated, said pawl engages a striker with a compression pulling force;

wherein in said engaged state, said lever/handle transitions from a free rotational movement to a movement under a resistance;

wherein in said detent state, said pawl has moved laterally outwardly to release said compression pulling force and permit a limited separation of said latch from said striker without completely releasing said pawl from said striker; and wherein in said open state, said pawl is released from said striker and rotated into said housing.

3. The latch of claim 2, wherein in said detent state, said lever/handle is retrained in a rotational position by a spring detent force.

4. The latch of claim 3, wherein in said open state said lever/handle is held against rotational movement.

5. The latch of claim 4, wherein said cam slot has three lobes formed by an arcuate slot having a right-hand, counter-clockwise lobe, a left-hand clockwise lobe, and a side recess at mid-arc.

6. The latch of claim 5, wherein said cam slot rotates with said lever/handle rotation and wherein in said closed state said cam follower is in said side recess, in said engaged state said cam follower abuts the cam wall opposite said side recess, in said detent state said cam follower is in said right-hand, counterclockwise lobe, and in said open state said cam follower is in said left-hand, clockwise lobe.

7. The latch of claim 6, wherein in said open state, said pawl is retracted into said housing.

8. The latch of claim 7, wherein in said open state at least a second one of said links extends outwardly from said housing to engage said striker when said latch housing is proximate thereto, to position said latch housing away from said striker.

9. The latch of claim 8, also including an abutment shoulder on said lever/handle, wherein in said open state said first link engages said abutment shoulder to hold said lever/handle from rotating.

10. The latch of claim 9, wherein said second link engagement with said striker causes said first link to disengage from said abutment shoulder permitting said latch to transition from said open state to said closed state.

11. The latch of claim 10, also including a detent retainer establishing a detent position for said detent ball, and a detent spring biasing said detent ball into said retainer.

12. The latch of claim 1, also including lever/handle biasing spring biasing the lever/handle to the closed state.

13. The latch of claim 12, also including a link biasing spring biasing said second link to an outwardly extended position and biasing said pawl to assist its lateral movement into the housing.

14. The latch of claim 13, wherein said link biasing spring is a floating spring having a first and second end, wherein the first end is coupled to the housing and the second end is coupled between two of said interconnected links.

15. A lever operated compression latch for engaging a striker, comprising:

a housing;

a pawl having a striker engagement member;

a lever/handle positioned within said housing and extending outwardly there from, said lever/handle being rotationally operative on a fixed pivot attached to said housing; and a first, second and third links, said first link being connected between said lever/handle and said pawl, said second link being connected between said pawl and said third link, and said third link being connected to said housing, said first link further comprising a detent feature at one end thereof; and a detent ball positioned within said housing;

wherein the movement of said lever/handle moves said first, second and third links which causes said pawl to move, first, in a lateral direction until said detent ball engages said first link detent feature and then, second, in a rotational direction, said directional movements being sequential.

16. The latch of claim 15, wherein said lever/handle rotates about a first fixed pivot point, wherein said first link rotates about a second fixed pivot point, and wherein said third link is fixed at a first end thereof to rotate about a third fixed pivot point, and wherein said pawl includes an elongate slot engaging a fourth fixed point implemented by a fixed post.

17. The latch of claim 16, including an interaction between said pawl elongate slot and said fixed post enables said pawl lateral movement and said pawl rotational movement.

18. The latch of claim 17, wherein said lever/handle includes a cam slot, and wherein said first link includes a cam follower at a first end, wherein said first link connection to said lever/handle is with a connection of said cam follower to said cam slot.

19. The latch of claim 18, wherein the connection of the first link to said pawl is at another end of said first link having a first floating pivot point.

20. The latch of claim 19, wherein said second link is connected at a first end thereof to said first floating pivot point and at another end to another end of said third link with a second floating pivot point.

21. The latch of claim 20, also including a first spring biasing said lever/handle in a first direction of rotation, and including a second spring biasing said pawl in a first direction of lateral movement and thereafter a first direction of rotational movement.

22. The latch of claim 21, wherein said second spring is a torsion spring connected on one end to said housing and on a second end to said first floating pivot point.

23. The latch of claim 22, wherein said second spring is a floating spring.

24. The latch of claim 23, wherein said first spring is a torsion spring positioned at said first fixed pivot point and being connected at one end to said lever/handle and at a second end to said housing.

25. A lever operated compression latch for engaging a striker, comprising:

a housing;

a pawl positioned within said housing for longitudinal/lateral motion and for rotational motion performed sequentially, said pawl having a striker engaging and holding member, said lateral motion and said rotational motion being in the same plane;

a lever/handle positioned within said housing for rotational motion in a plane parallel to the pawl motion plane, a portion of said lever/handle extending outside of said housing;

a plurality of links connecting said lever/handle to said pawl and to said housing, wherein the rotation of said lever/handle is back and forth in a partial circular arc, said plurality of links including a first link having a detent feature at one end thereof; and a detent ball positioned within said housing, wherein the sequence of motions of said pawl when said latch is closing is to rotate outwardly to engage said striker and said detent ball engages said first link detent feature, then to retract laterally to provide a compression in latching, and the sequence of motions of said pawl when said latch is opening is to extend laterally outward to release the compression until said detent ball engages said first link detent feature and then to rotate to retract into the housing to withdraw from the striker, wherein the latching closing and unlatching opening movements of the pawl are reverse of each other.

26. The latch of claim 25, also including a holding member prohibiting the lever/handle from movement when it is in a fully unlatched open state.

27. The latch of claim 26, wherein when in the fully unlatched open state, at least one of said connecting links extends outward from said housing, wherein when said housing is moved towards said striker, said outward extending link contacts said striker thereby releasing said holding member from prohibiting the lever/handle movement.

28. The latch of claim 27, wherein when said pawl is rotated to engage said striker said outward extending link is retracted into said housing.

29. The latch of claim 27, wherein the pawl outward lateral movement is stoppable before the retract rotation begins, said stoppage defining a predetermined gap between the housing and the striker.

30. A lever operated compression latch for engaging a striker, comprising:

a housing;

a pawl associated with said housing being movable to engage and then hold said striker to close said latch and to release from and then to withdraw from said striker to open said latch;

a lever/handle associated with said housing and connected to move said pawl, said lever/handle to pawl connection including a floating point connection;

a link attached to said lever/handle and said pawl, said link having a detent feature at one end thereof; and a detent ball associated with said housing, wherein said lever/handle has a first detent position in which said detent ball engages said link detent feature.

31. The latch of claim 30, wherein said lever/handle has a second detent position, wherein said first detent position presents a resistance to further lever/handle movement which can be overcome by applying additional force to said lever/handle, and said second detent position presents a positive stop against further lever/handle movement.

32. The latch of claim 31, wherein in said striker hold position, said pawl exerts a compression pull force on said housing, and wherein in said striker release position, said pawl releases said compression pull force.

33. The latch of claim 32, wherein in said lever/handle first detent position, said pawl is about to be released from said striker hold position.

34. The latch of claim 33, wherein in said lever/handle second detent position, said pawl is in said withdrawn position.

35. A lever operated compression latch for engaging a striker, comprising:

a housing having a housing pivot pin;

a hook-ended pawl positioned within said housing and operative to extend therefrom to engage a striker, said pawl having a pawl slot and said housing pivot pin being positioned within the pawl slot, said pawl slot configured such that said pawl is capable of sliding and rotating relative to said housing pivot pin;

a lever/handle having a cam slot and being rotatably mounted within said housing and having a portion extending therefrom; and a plurality of interconnected links connected to said lever/handle and to said pawl; wherein a first one of said links has a cam follower engaged with said lever/handle cam slot; and wherein said cam follower and said cam slot cooperate to establish a closed, an engaged, a detent and an open states for said latch.

36. The latch of claim 35, wherein in said closed stated, said pawl engages a striker with a compression pulling force;

wherein in said engaged state, said lever/handle transitions from a free rotational movement to a movement under a resistance;

wherein in said detent state, said pawl has moved laterally outwardly to release said compression pulling force and permit a limited separation of said latch from said striker without completely releasing said pawl from said striker; and wherein in said open state, said pawl is released from said striker and rotated into said housing.

37. The latch of claim 36, wherein in said detent state, said lever/handle is retrained in a rotational position by a spring detent force.

38. The latch of claim 37, wherein in said open state said lever/handle is held against rotational movement.

39. The latch of claim 35, wherein said cam slot has three lobes formed by an arcuate slot having a right-hand, counterclockwise lobe, a left-hand clockwise lobe, and a side recess at mid-arc.

40. The latch of claim 39, wherein said cam slot rotates with said lever/handle rotation and wherein in said closed state said cam follower is in said side recess, in said engaged state said cam follower abuts a cam wall opposite said side recess, in said detent state said cam follower is in said right-hand, counterclockwise lobe, and in said open state said cam follower is in said left-hand, clockwise lobe.

41. The latch of claim 35, wherein in said open state, said pawl is retracted into said housing.

42. The latch of claim 35, wherein in said open state at least a second one of said links extends outwardly from said housing to engage said striker when said latch housing is proximate thereto, to position said latch housing away from said striker.

43. The latch of claim 35, also including an abutment shoulder on said lever/handle, wherein in said open state said first link engages said abutment shoulder to hold said lever/handle from rotating.

44. The latch of claim 43, wherein said second link engagement with said striker causes said first link to disengage from said abutment shoulder permitting said latch to transition from said open state to said closed state.

45. The latch of claim 35, also including a detent ball, a detent retainer establishing a detent position for said ball, and a detent spring biasing said ball into said retainer.

46. The latch of claim 45, wherein said first link has a detent feature at one end thereof, and wherein said ball engages said first link detent feature in said detent state.

47. The latch of claim 35, also including lever/handle biasing spring biasing the lever/handle to the closed state.

48. The latch of claim 35, also including a link biasing spring biasing said second link to an outwardly extended position and biasing said pawl to assist its lateral movement into the housing.

49. The latch of claim 48, wherein said link biasing spring is a floating spring having a first and second end, wherein the first end is coupled to the housing and the second end is coupled between two of said interconnected links.

* * * * *